US010391365B1

(12) United States Patent
Stillinger et al.

(10) Patent No.: US 10,391,365 B1
(45) Date of Patent: Aug. 27, 2019

(54) TOSSING BALLS

(71) Applicant: Acorn Products, LLC, Monte Sereno, CA (US)

(72) Inventors: Scott H. Stillinger, Monte Sereno, CA (US); Kathryn Kelsey Anne Stillinger, Los Gatos, CA (US); Diane B. Stillinger, Monte Sereno, CA (US)

(73) Assignee: Acorn Products, LLC, Monte Sereno, CA (US)

( * ) Notice: Subject to any disclaimer, the term of this patent is extended or adjusted under 35 U.S.C. 154(b) by 0 days.

(21) Appl. No.: 15/898,050

(22) Filed: Feb. 15, 2018

(51) Int. Cl.
*A63B 43/00* (2006.01)
*A63B 71/00* (2006.01)

(52) U.S. Cl.
CPC ..... *A63B 43/002* (2013.01); *A63B 71/0054* (2013.01); *A63B 2071/0063* (2013.01); *A63B 2209/00* (2013.01); *A63B 2225/09* (2013.01)

(58) Field of Classification Search
CPC ..... A63B 43/002; A63B 71/0054; A63B 2071/0063; A63B 2209/00; A63B 2225/09; A63B 43/00; A01K 15/025; A01K 15/026; A63H 33/18; A63H 33/003; A61H 15/00; A61H 2015/0042
USPC ..... D21/707
See application file for complete search history.

(56) References Cited

U.S. PATENT DOCUMENTS 2,011,760 A 8/1935 Gallinant
2,131,756 A * 10/1938 Roberts ..... A63B 39/00 473/605
2,952,460 A 9/1960 Ellis
3,046,016 A * 7/1962 Laws ..... A63F 3/00094 273/241
3,218,071 A * 11/1965 Richard ..... A63B 43/00 446/457

(Continued)

FOREIGN PATENT DOCUMENTS

GB 2426212 10/2009

OTHER PUBLICATIONS

"Inside Out Ball—Large—Value Plus—4 Pack." SensoryTools.net. Sensory Tools Australia, Nov. 8, 2017.

(Continued)

*Primary Examiner* — Steven B Wong
(74) *Attorney, Agent, or Firm* — Dascenzo Intellectual Property Law, P.C.

(57) ABSTRACT

Tossing balls having a resilient skeletal body formed from a plurality of interconnected resilient ribs and defining an open internal volume and a plurality of passages between adjacent resilient ribs. The passages extend from an outwardly facing body portion of the body to the internal volume. The tossing balls may include an array of force-absorbing resilient fingers extending from the plurality of interconnected resilient ribs. The resilient fingers extend at least one of away from and toward the open internal volume. The tossing balls may have a nominal configuration in which the array of force-absorbing resilient fingers extends away from the open internal volume and is configured to cushion impact between the tossing ball and an external object. The tossing balls may include an everted configuration in which the resilient fingers that extended away from the open internal volume in the nominal configuration extend into the open internal volume.

27 Claims, 15 Drawing Sheets

(56) References Cited

U.S. PATENT DOCUMENTS

| | | | | | |
|---|---|---|---|---|---|
| 3,889,950 | A | * | 6/1975 | Kasravi | A63H 33/18 190/1 |
| 3,987,580 | A | | 10/1976 | Ausnit | |
| 3,999,748 | A | * | 12/1976 | Clarke | A63B 43/005 273/348.4 |
| 4,131,276 | A | | 12/1978 | Judkins | |
| 4,240,639 | A | * | 12/1980 | Bolton | A63B 43/005 428/100 |
| D265,573 | S | * | 7/1982 | Clarke | D21/406 |
| 4,660,830 | A | | 4/1987 | Tomar | |
| 4,756,529 | A | | 7/1988 | Stillinger | |
| 4,850,927 | A | * | 7/1989 | Caranica | A63H 3/003 446/369 |
| 4,962,926 | A | * | 10/1990 | Chen | A63B 43/00 446/490 |
| 4,974,844 | A | * | 12/1990 | Richards | A63B 43/002 273/DIG. 20 |
| 4,991,841 | A | * | 2/1991 | Paranto | A63B 43/00 446/490 |
| D318,506 | S | * | 7/1991 | Caranica | D21/468 |
| D332,982 | S | * | 2/1993 | Norman | D21/713 |
| D385,002 | S | * | 10/1997 | Schloss | D21/707 |
| 5,848,946 | A | | 12/1998 | Stillinger | |
| 6,026,534 | A | | 2/2000 | Gonda et al. | |
| 6,089,939 | A | * | 7/2000 | Dyson | A63H 33/18 446/46 |
| 6,280,356 | B1 | | 8/2001 | Sandeen | |
| D473,021 | S | * | 4/2003 | Gourley | D30/160 |
| 6,622,659 | B2 | * | 9/2003 | Willinger | A01K 15/025 119/702 |
| 6,645,101 | B1 | | 11/2003 | Wong | |
| 6,729,984 | B2 | | 5/2004 | Silverglate | |
| D501,520 | S | * | 2/2005 | Fraze | D21/707 |
| 6,863,588 | B1 | | 3/2005 | Chu | |
| D561,277 | S | | 2/2008 | Chernick et al. | |
| 7,470,203 | B1 | | 12/2008 | Stillinger | |
| D623,247 | S | * | 9/2010 | Zawitz | D21/707 |
| 7,803,033 | B1 | * | 9/2010 | Walterscheid | A63H 37/005 446/308 |
| D631,213 | S | * | 1/2011 | Morton | D30/160 |
| D680,698 | S | * | 4/2013 | McWilliams | D30/121 |
| 8,464,665 | B1 | | 6/2013 | Scheffler et al. | |
| 8,486,510 | B2 | * | 7/2013 | Wechsler | B29C 33/005 264/318 |
| D717,521 | S | * | 11/2014 | Slusarczyk | D1/130 |
| 9,636,601 | B2 | | 5/2017 | Reynolds | |
| 2002/0124811 | A1 | * | 9/2002 | Willinger | A01K 15/025 119/707 |
| 2006/0057932 | A1 | * | 3/2006 | Gick | A01K 15/025 446/269 |
| 2006/0084355 | A1 | * | 4/2006 | Wong | A63H 33/00 446/71 |
| 2006/0224239 | A1 | | 10/2006 | Tiahrt | |
| 2007/0270233 | A1 | * | 11/2007 | Ruston | A63B 37/0003 473/280 |
| 2008/0090486 | A1 | * | 4/2008 | Zawitz | A63H 33/008 446/124 |

OTHER PUBLICATIONS

"Puffer Bracelet Puffer Bracelet Stress ball . . . " Aliexpress.com. Alibaba Group, Nov. 8, 2017.

"Reversible Polyhedron." ttcn.ne.jp. The World of Geometric Toy, Nov. 8, 2017.

"Hollow Ball Pet Toy—3.25." Target.com. Oct. 24, 2017.

"Neon Inside-Out Ball Pack." funandfunction.com. Fun and Function, Nov. 9, 2017.

* cited by examiner

TOSSING BALLS

FIELD OF THE DISCLOSURE

The present disclosure is directed generally to the field of amusement devices that are suitable for use by both children and adults, and more particularly to the field of tossing balls.

BACKGROUND OF THE DISCLOSURE

Many balls have been developed for use in various sports, games, and other recreational activities. Some balls, such as those used in sports, tend to be formed from materials that result in a hard and/or solid exterior of the ball. Some balls, such as those that are designed for use by children or others who are not as adept at throwing and catching, may be formed from materials that provide a softer ball. Such balls may be less likely to injure the user, especially if the ball impacts the user, such as if the user is unsuccessful at catching the ball. Examples of balls that are designed for use by both children and adults include Nerf® balls, Koosh® balls (U.S. Pat. No. 4,756,529), and Oball® balls (U.S. Pat. No. 6,729,984). In many of these activities, the play balls are formed from a soft material, are lightweight, and/or are formed from a foamed material. These conventional balls provide a safer way for younger and/or less dexterous users to participate in activities utilizing balls. However, the construction of these balls may not facilitate easier grasping and/or catching of the balls. Also, such balls may lack play value beyond their primary use as a play ball.

SUMMARY OF THE DISCLOSURE

Tossing balls having a resilient skeletal body are disclosed herein. The tossing balls include a plurality of interconnected resilient ribs that form the resilient skeletal body of the tossing ball. The resilient skeletal body defines an open internal volume of the tossing ball and a plurality of passages between adjacent resilient ribs of the plurality of interconnected resilient ribs. Each of the plurality of passages extends from an outwardly facing body portion of the resilient skeletal body to the open internal volume such that a user's fingers may extend through at least one of the passages and into the open internal volume when the ball is grasped in or thrown by a user's hand. In some embodiments, the tossing balls further include an array of force-absorbing resilient fingers extending from the plurality of interconnected resilient ribs. The force-absorbing resilient fingers each extend away from or toward the open internal volume of the tossing balls. In some embodiments, each of the plurality of interconnected resilient ribs includes a plurality of the force-absorbing resilient fingers. In some embodiments, the tossing balls have a nominal configuration in which the array of force-absorbing resilient fingers extend away from the open internal volume of the tossing ball. In some embodiments, the tossing balls also include an everted configuration in which the plurality of force-absorbing resilient fingers that extended away from the open internal volume in the nominal configuration extend into the open internal volume.

DETAILED DESCRIPTION

FIGS. 1-18 provide examples of tossing balls 10 according to the present disclosure. Elements that serve a similar, or at least substantially similar, purpose are labeled with like numbers in each of FIGS. 1-18, and these elements may not be discussed in detail herein with reference to each of FIGS. 1-18. Similarly, all elements may not be labeled in each of FIGS. 1-18, but reference numbers associated therewith may be utilized herein for consistency. Elements, components, and/or features that are discussed herein with reference to one or more of FIGS. 1-18 may be included in and/or utilized with any of FIGS. 1-18 without departing from the scope of the present disclosure.

In general, elements that are likely to be in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a given embodiment without departing from the scope of the present disclosure.

Figure 1:
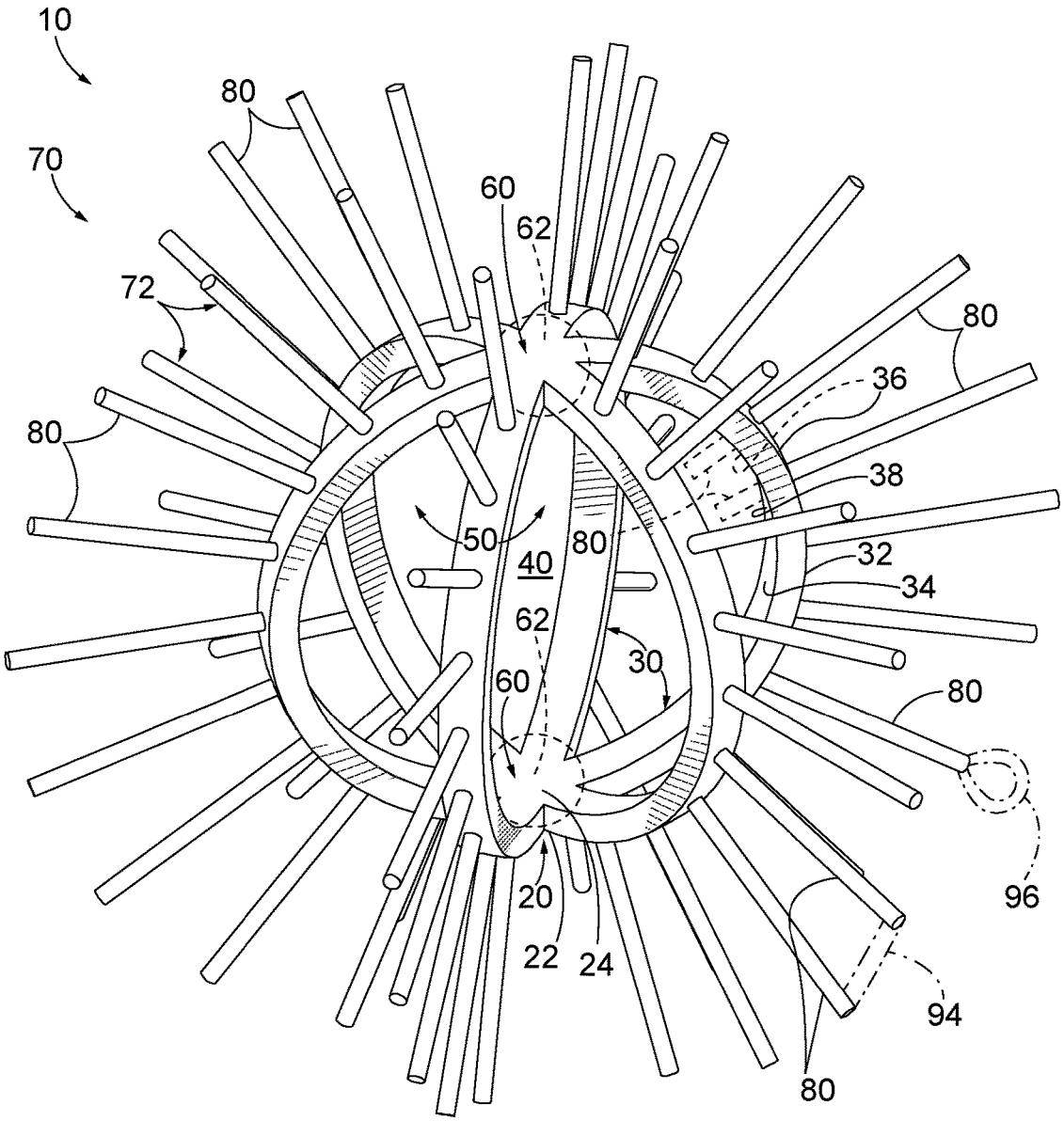
FIG. 1 is an isometric view schematically illustrating tossing balls according to the present disclosure.
Figure 2:
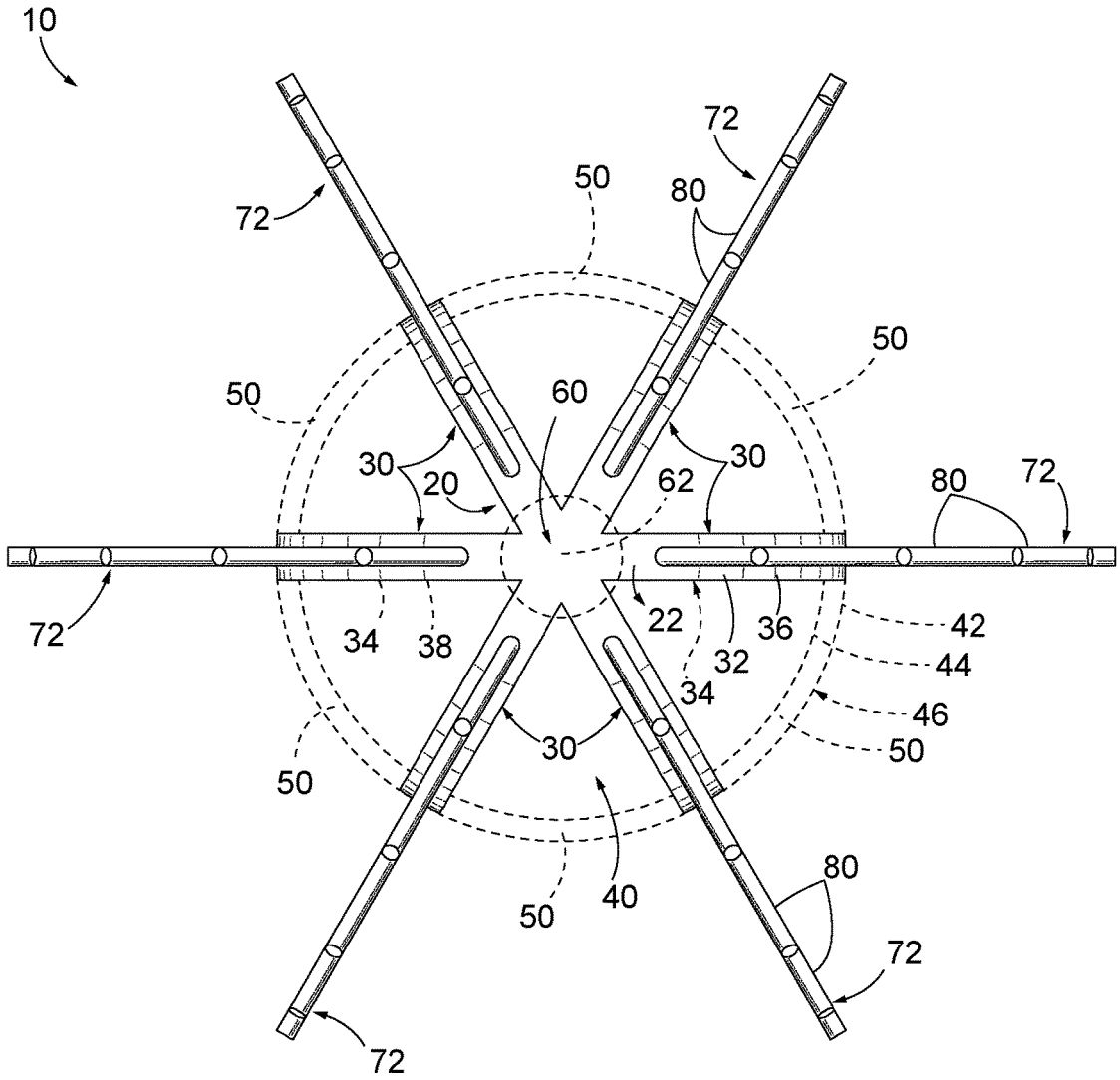
FIG. 2 is a top plan view of the tossing ball of FIG. 1.

FIGS. 1 and 2 schematically illustrate examples of a tossing ball 10 according to the present disclosure. As depicted, tossing ball 10 includes a resilient skeletal body 20 that is at least substantially, if not completely, formed from a plurality of interconnected resilient ribs 30. Resilient skeletal body 20 defines an open internal volume 40 of tossing ball 10 and a plurality of passages 50 that extend from the internal volume to the external surface of the body, such as by extending between adjacent ribs of the plurality of interconnected resilient ribs. Thus, a tossing ball 10 according to the present disclosure has an "open" frame structure that has more open, or void, space than solid structure. The resilient nature of the body provides a structure that may deflect or otherwise resiliently deform in response to imparted external forces that are at least partially absorbed by the ball, such as during catching of the ball and/or when the ball is thrown against an external object. As described in more detail herein, such a resilient, open-frame construction may facilitate easier catching and grasping of the tossing ball, especially by users who may lack the hand size, hand strength, and/or reflexes to catch a similarly sized ball with a solid exterior, such as a golf ball, baseball, football, etc.

In FIGS. 1-2, resilient skeletal body 20 is depicted as having a spherical, or generally spherical, shape. In addition to providing a specific graphical example of such a shape for resilient skeletal body 20, FIGS. 1-2 also are intended to schematically illustrate that tossing balls 10 may have a three-dimensional geometric shape other than spherical shapes when the ball is in a resting, or undeformed, configuration. This shape additionally or alternatively may be referred to as a first geometric shape, a primary geometric shape, and/or the shape of the resilient skeletal body when the resilient skeletal body (and/or tossing ball 10) is in a nominal configuration. Examples of suitable geometric shapes for resilient skeletal body 20, such as when tossing ball 10 is in its nominal configuration, include spherical, ellipsoidal, ovoid, spheroid, ellipsoid, and globular shapes. Additional examples include cubic, tetrahedral, pyramidal, hexahedral, octahedral, decahedral, and dodecahedral shapes.

As used herein, tossing ball 10 additionally or alternatively may be referred to as ball 10, play ball 10, resilient ball 10, force-absorbing ball 10, tactile ball 10, amusement toy 10, tactile amusement toy 10, children's ball 10, manipulative toy 10, tactile toy 10, reconfigurable toy 10, resiliently collapsible toy 10, force-absorbing toy ball 10, and/or resilient toy ball 10. As used herein, resilient skeletal body 20 additionally or alternatively may be referred to as a skeletal geometric framework 20, a resilient geometric framework 20, and/or an open geometric framework 20. As used herein, resilient ribs 30 additionally or alternatively may be referred to as force-absorbing ribs 30, struts 30, splines 30, members 30, arms 30, and/or beams 30 of resilient skeletal body 20 of tossing ball 10.

In FIGS. 1-2, tossing ball 10 is shown with six interconnected resilient ribs 30. FIGS. 1-2 also are intended to illustrate, schematically, that tossing balls 10 according to the present disclosure include a plurality of interconnected resilient ribs 30 and that such plurality of resilient interconnected ribs 30 includes at least 3 ribs 30, and may include four ribs 30, at least four ribs 30, five ribs 30, at least five ribs 30, six ribs 30, at least six ribs 30, eight ribs, at least eight ribs 30, less than fifteen ribs 30, less than ten ribs 30, less than eight ribs 30, less than seven ribs 30, and/or less than six ribs 30. In addition, FIGS. 1-2 are intended to schematically depict ribs 30 without being limited to a particular rib thickness, length, width, cross-sectional shape, etc. It is within the scope of the present disclosure that ribs 30 may have any suitable cross-sectional shape, with examples including rectilinear, circular, ovate, triangular, pentagonal, hexagonal, hollow, solid, concave, grooved, ridged, and/or other regular or irregular polygonal shapes.

Regardless of the number of ribs comprising the plurality of interconnected resilient ribs 30, each rib 30 is interconnected at a node 60 with at least one, and optionally more than one, more than two, more than three, half, at least half, a majority, a substantial majority, at least substantially all, and/or all of the other ribs of the plurality of interconnected resilient ribs 30. Thus, and as used herein, a node 60 refers to the region, component, and/or structure of tossing ball 10 (and/or resilient skeletal body 20 thereof) at which two or more of the plurality of interconnected ribs 30 are connected together, either directly to each other or directly to a coupler, or coupling structure, 62 that interconnects the corresponding ribs.

As indicated in FIG. 1, each rib 30 may be described as having an outwardly facing surface 32 that faces generally away from internal volume 40 and an inwardly facing surface 34 that faces toward internal volume 40. Inwardly facing surfaces 34 additionally or alternatively may be described as bounding and/or defining internal volume 40. Expressed in different terms, resilient skeletal body 20 may be described as having an outwardly facing body portion 22 that faces generally away from internal volume 40 and an inwardly facing body portion 24 that faces toward internal volume 40, with the inwardly facing body portion optionally being described as bounding and/or defining internal volume 40. Outwardly facing body portion 22 may be described as being at least substantially formed from the outwardly facing surfaces 32 of the plurality of interconnected ribs, and inwardly facing body portion 24 may be described as being at least substantially formed from the inwardly facing surfaces of the plurality of interconnected ribs. When ribs 30 have outwardly and inwardly facing surfaces 32 and 34 with non-planar cross-sectional shapes, the outwardly facing surfaces represent the portion of the rib (curved, concave, convex, partially planar, etc.) that face generally away from the open internal volume 40 and/or center of the tossing ball, and the inwardly facing surfaces represent the portion of the rib (curved, concave, convex, partially planar, etc.) that face generally toward the open internal volume and/or center of the tossing ball.

Passages 50 are the spaces between adjacent ribs 30, such as which are within the conformational volume 46 defined between the corresponding outwardly facing surfaces 32 and inwardly facing surfaces 34 of the adjacent ribs 30. As used herein, a conformational volume refers to the surface defined by the corresponding portion of tossing ball 10, such as if tossing ball 10 is rotated about its axis and/or center and/or if the passages 50 instead were occupied by solid material. The center of a tossing ball 10 additionally or alternatively may be, or may be referred to, as the geometric center of the tossing ball. Thus, and as schematically illustrated in FIG. 2, an external conformational volume 42 of tossing ball 10 is a sphere having a radius that extends from the center of tossing ball 10 to outwardly facing surface 32 of a rib 30. An internal conformational volume 44 of tossing ball 10 is a sphere having a radius that extends from the center of tossing ball 10 to inwardly facing surface 34 of a rib 30. The conformational volume 46 that is defined between the external and internal conformational volumes represents the collective volume occupied by passages 50 and ribs 30.

Figure 3:
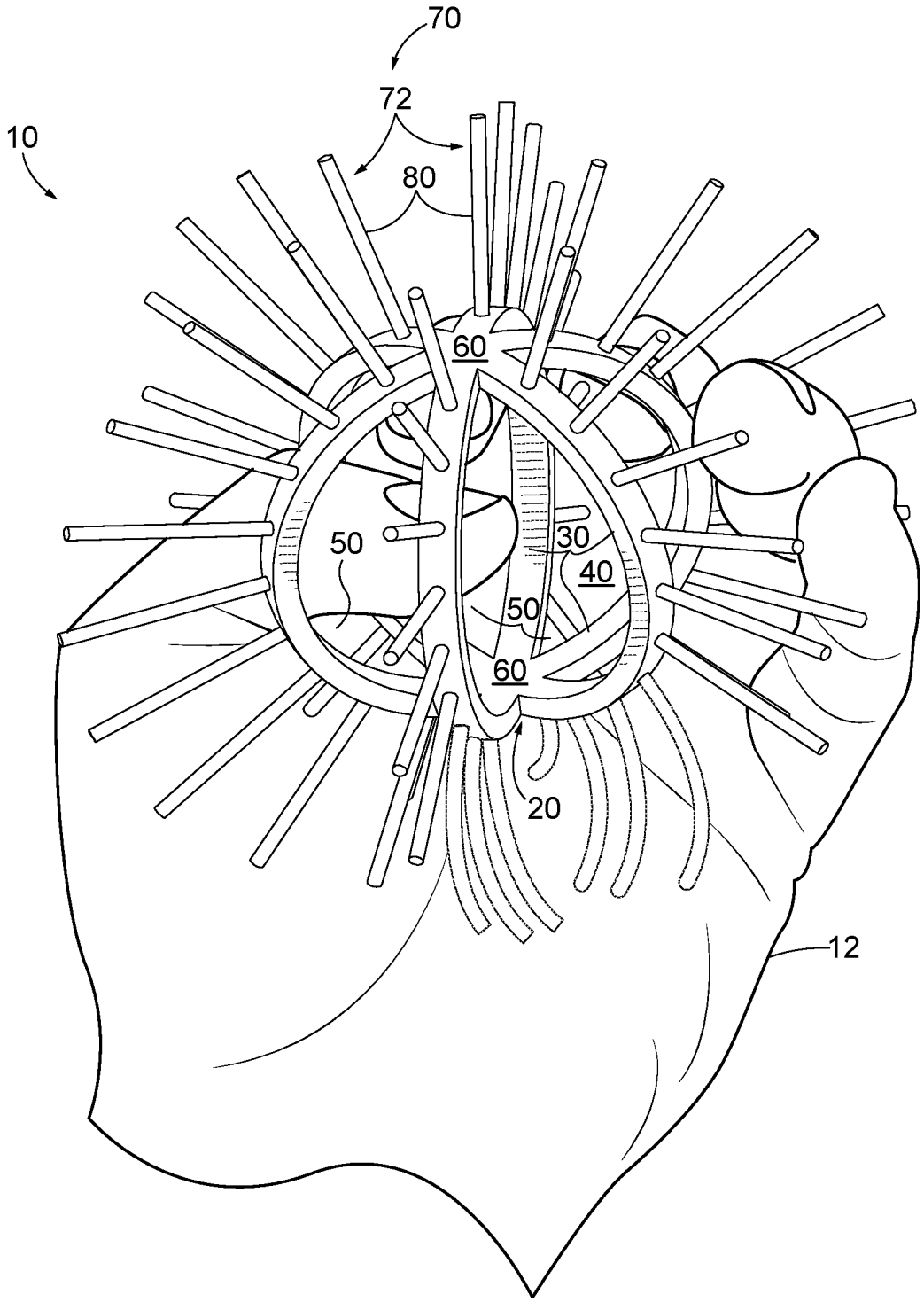
FIG. 3 is a perspective view of the tossing ball of FIG. 1 being grasped in a user's hand.

To reach into the internal volume 40 of tossing ball 10 from external the tossing ball, a user's finger needs to pass between adjacent ribs 30 and thus through one of passages 50 before entering the internal volume of ball 10. This is illustrated in FIG. 3, in which ball 10 is shown being grasped in a user's hand, such as prior to throwing the tossing ball or after catching the ball. As shown, several of the user's fingers extend through respective passages 50 and into internal volume 40. It follows that each of passages 50 should be sized to permit at least one of a user's fingers to pass through the passage, such as when tossing ball 10 is held, thrown, and/or caught by a user.

Passages 50 of a play ball 10 may form, or occupy, a larger percentage of conformational volume 46 of resilient skeletal body 20 than the percentage that is formed, or occupied, by the plurality of interconnected resilient ribs 30. In other words, there is more void, or open, space in conformational volume 46 than space occupied by ribs 30. Examples of the percentage of conformational volume 46 formed by passages 50 include at least 55%, at least 60%, at least 70%, at least 75%, at least 80%, at least 90%, less than 90%, less than 80%, less than 75%, and/or less than 70%. Examples of sizes for passages 50 include areas of at least 0.5 $cm^2$, at least 1 $cm^2$, at least 1.5 $cm^2$, at least 2 $cm^2$, at least 2.5 $cm^2$, at least 3.5 $cm^2$, at least 4.5 $cm^2$, at least 5.5 $cm^2$, at least 6.5 $cm^2$, at least 7.5 $cm^2$, less than 10 $cm^2$, less than 7 $cm^2$, less than 5 $cm^2$, less than 4 $cm^2$, less than 2.5 $cm^2$, and/or less than 2 $cm^2$.

Tossing balls 10 according to the present disclosure may have a variety of sizes, including sizes in which the balls are dimensioned to be caught by and/or thrown by a user's hand. As examples, tossing balls 10 (and/or resilient skeletal bodies 20 thereof) thus may have a maximum linear body dimension that is at least 2 cm, at least 3.5 cm, 5 cm, at least 7.5 cm, at least 10 cm, at least 13 cm, at least 15 cm, at least 18 cm, less than 25 cm, less than 20 cm, less than 15 cm, less than 12 cm, less than 10 cm, less than 7.5 cm, less than 5 cm, in the range of 5-15 cm, in the range of 7.5-12.5 cm, in the range of 7.5-17.5 cm, and/or in the range of 10-20 cm. As used herein, the maximum linear body dimension refers to the longest straight distance that can be measured between spaced-apart portions of the resilient skeletal body 20 of ball 10. As an example, for a resilient skeletal body 20 having a spherical shape in the nominal configuration, the maximum linear body dimension is the diameter of the resilient skeletal body.

As also shown in FIGS. 1-4, tossing balls 10 according to the present disclosure also may include an array 70 of force-absorbing resilient fingers 80 that extend at least from the plurality of interconnected resilient ribs 30. As shown, the resilient fingers 80 may extend from an outwardly facing surface 32 of resilient ribs 30, thereby expanding the overall size of tossing ball 10, and providing the tossing ball with a spiky (albeit soft) appearance. Moreover, the elongate, resilient nature of the outwardly extending fingers 80 may provide tossing balls 10 with enhanced play value, as the fingers may create wavy and/or undulating movements or patterns of movements as a tossing ball is moved, tossed, or shaken, and/or as a user's finger is moved in sequential contact with a plurality of adjacent resilient fingers 80 of the array 70 of force-absorbing resilient fingers 80.

The array 70 of force-absorbing resilient fingers 80 may include at least one plurality 72 of force-absorbing resilient fingers 80 on a subset of ribs 30, on a majority of ribs 30, on at least a substantial portion of ribs 30, and/or on each of ribs 30. Thus, it also is within the scope of the present disclosure that at least one, more than one, a minority, a majority, substantially all, or even all of the ribs may not include a plurality 72 of force-absorbing fingers 80. It also is within the scope of the present disclosure that other components of tossing ball 10 also may include force-absorbing resilient fingers 80 projecting therefrom, with examples being node 60 and/or coupler 62. As used herein, fingers 80 additionally or alternatively may be described as tendrils 80, spikes 80, posts 80, filaments 80, projections 80, needles 80, and/or shafts 80.

For each rib 30 that contains a plurality 72 of force-absorbing resilient fingers 80, the fingers may extend from the outwardly facing surface 32 of the rib (as shown in solid lines in FIG. 1), the inwardly facing surface 34 of the rib (as schematically indicated in dashed lines in FIG. 1), or both. Force-absorbing resilient fingers 80 that extend from the outwardly facing surface 32 of ribs 30 additionally or alternatively may be described as extending away from open internal volume 40 of the tossing ball, and force-absorbing resilient fingers 80 that extend from the inwardly facing surface 34 of ribs 30 additionally or alternatively may be described as extending into open internal volume 40 of the tossing ball.

Figure 4:
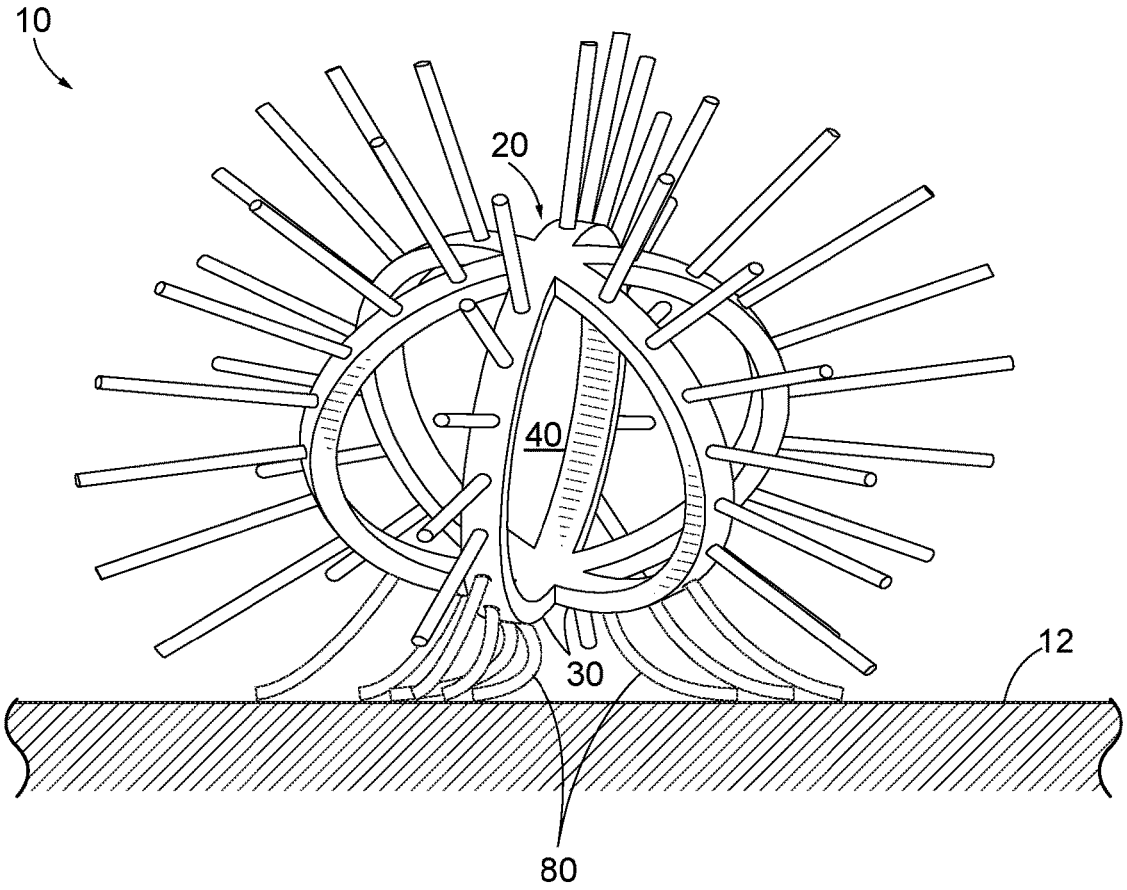
FIG. 4 is an elevation view of the tossing ball of FIG. 1 impacting an external object.

At least force-absorbing resilient fingers 80 that extend from the outwardly facing surface 32 of ribs 30 may be configured to cushion impact between tossing ball 10 and an external object 12, as somewhat schematically illustrated in FIG. 4. Thus, such force-absorbing resilient fingers 80 will impact external object 12 before the remainder of the tossing ball and will absorb some of the impact forces that otherwise would be imparted to the resilient skeletal body if the fingers were not present. As a result, a tossing ball 10 with force-absorbing resilient fingers 80 may not rebound as much, as far, and/or as quickly away from an external object during an impact with the external object, as compared to an otherwise identical tossing ball that does not include fingers 80. In FIG. 4, external object 12 is schematically illustrated and may represent objects having any shape, construction, etc. Examples of such objects include walls, targets, gloves, bats, bodies of living creatures, a user's body, a user's hand (such as shown in FIG. 3), etc. Thus, the force-absorbing, impact-cushioning, and/or rebound-dampening properties imparted to tossing balls 10 by fingers 80 may make the balls easier to catch in a user's hand (such as somewhat schematically depicted in FIG. 3) than an otherwise identical ball that does not include fingers 80. Fingers 80 also may assist a user to catch tossing ball 10 because a user may grasp one or more fingers 80, alone or in addition to one or more ribs 30 of resilient skeletal body 20, when catching the tossing ball.

As discussed, force-absorbing resilient fingers 80 are not the only resilient portion of tossing balls 10, as body 20 is a resilient skeletal body that is formed from a plurality of interconnected resilient ribs 30. Thus, the resiliency of the plurality of interconnected resilient ribs 30 also may contribute to the force-absorbing, impact-cushioning, and/or rebound-dampening properties of play balls 10. Thus, when ball 10 impacts an external object, such as shown in FIG. 4, resilient skeletal body 20 (and thus ribs 30) also will deform from its shape in the ball's nominal configuration. This deformation may include resilient deflection of at least a portion of body 20 (and/or ribs 30) toward the center of the ball and/or toward the open internal volume. This deformation may absorb some of the external forces that are imparted to the ball from the impact with external object 12 and/or reduce the force with which the ball rebounds, or bounces, away from the external object.

As discussed, and as indicated in FIG. 1, ribs 30 include an outwardly facing surface 32 and an inwardly facing surface 34. The surface of a rib 30 from which a plurality 72 of force-absorbing resilient fingers 80 extends additionally or alternatively may be referred to herein as a projecting surface 36 of the rib 30. In contrast, a surface of a rib 30 from which a plurality 72 of force-absorbing resilient fingers 80 does not extend may be referred to as a contact surface 38 of the rib. Projecting surface 36 additionally or alternatively may be referred to as finger-contacting surface 36, finger-containing surface 36, and/or spiky surface 36. Contact surface 38 additionally or alternatively may be referred to as smooth surface 38 and/or fingerless surface 38. When fingers 80 extend from outwardly facing surface 32 of a rib 30, the fingers may be described as extending outwardly away from the center and/or internal volume 40 of the ball. When fingers 80 extend from inwardly facing surface 34 of a rib 30, the fingers may be described as extending into internal volume 40 and/or toward the center of the tossing ball 10.

Thus, some tossing balls 10 will include ribs 30 with a projecting surface 36 and an opposed contact surface 38, with one of these surfaces forming the outwardly facing surface of the ribs and the other of the surfaces forming the inwardly facing surface of the ribs. Other tossing balls 10 will include ribs 30 with a pair of opposed projecting surfaces 36, which in such an embodiment may be referred to as first and second projecting surfaces 36 and/or as first and second opposed projecting surfaces 36. In such a tossing ball 10, the outwardly and inwardly facing surfaces 32 and 34 of the ribs 30 both are projecting surfaces 36 from which separate pluralities 72 of force-absorbing resilient fingers 80 extend. The plurality 72 of force-absorbing resilient fingers 80 that extends from the first projecting surface 36 of a rib 30 may be referred to as a first plurality 72 of force-absorbing resilient fingers 80, and the plurality 72 of force-absorbing resilient fingers 80 that extends from the second projecting surface 36 of the rib 30 may be referred to as a second plurality 72 of force-absorbing resilient fingers 80.

Fingers 80 may be spaced along a projecting surface 36 of a rib 30 in any suitable spacing, including constant spacing, variable spacing, aligned spacing, misaligned spacing, random spacing, one row of fingers, one row of aligned fingers, more than one row of fingers, and/or more than one row of aligned fingers. Fingers 80 may have any suitable relative size, spacing, and shape with respect to other fingers 80 on the same projecting surface 36 of the same rib 30, on a different projecting surface 36 of the same rib 30, on the same rib 30, on other ribs 30, on a node 60, and/or on body 20. Similarly the number of fingers 80 on a particular rib 30, body 20, and/or tossing ball 10 may vary without departing from the scope of the present disclosure. Typically, the plurality of force-absorbing resilient fingers 80 on a rib 30 will be spaced apart along the projecting surface 36 of the rib, with each rib 30 including at least four, at least six, at least ten, at least fifteen, at least twenty, at least twenty-five, at least thirty, less than fifty, less than forty, less than thirty, less than twenty-five, less than twenty, less than twelve fingers 80, and/or less than eight fingers 80 on a projecting surface 36 of the rib 30. Although not required to a particular tossing ball 10, increasing the number and/or length of resilient fingers 80 on a projecting surface 36 of a rib 30 may increase the visual wavy, or undulating, feedback provided to a user as the tossing ball 10 is moved and/or receives imparted external forces.

When a tossing ball 10 includes first and second pluralities 72 of force-absorbing resilient fingers 80, the size, shape, number, and/or spacing of the fingers 80 of a first plurality 72 of force-absorbing resilient fingers 80 may be the same as, different than, smaller than, and/or greater than the size, shape, number, and/or spacing of the fingers 80 of the second plurality 72 of force-absorbing resilient fingers 80. As an example, all of the fingers 80 of the first and second pluralities 72 of force-absorbing resilient fingers 80 may have the same shape, size, and spacing between adjacent fingers on a projecting surface of a rib. As another example, the fingers 80 of the second plurality 72 of force-absorbing resilient fingers 80 may be at least one of smaller, larger, shorter, longer, more numerous, less numerous, more greatly spaced, and/or more closely spaced than the fingers of the first plurality 72 of force-absorbing resilient fingers 80.

Figure 5:
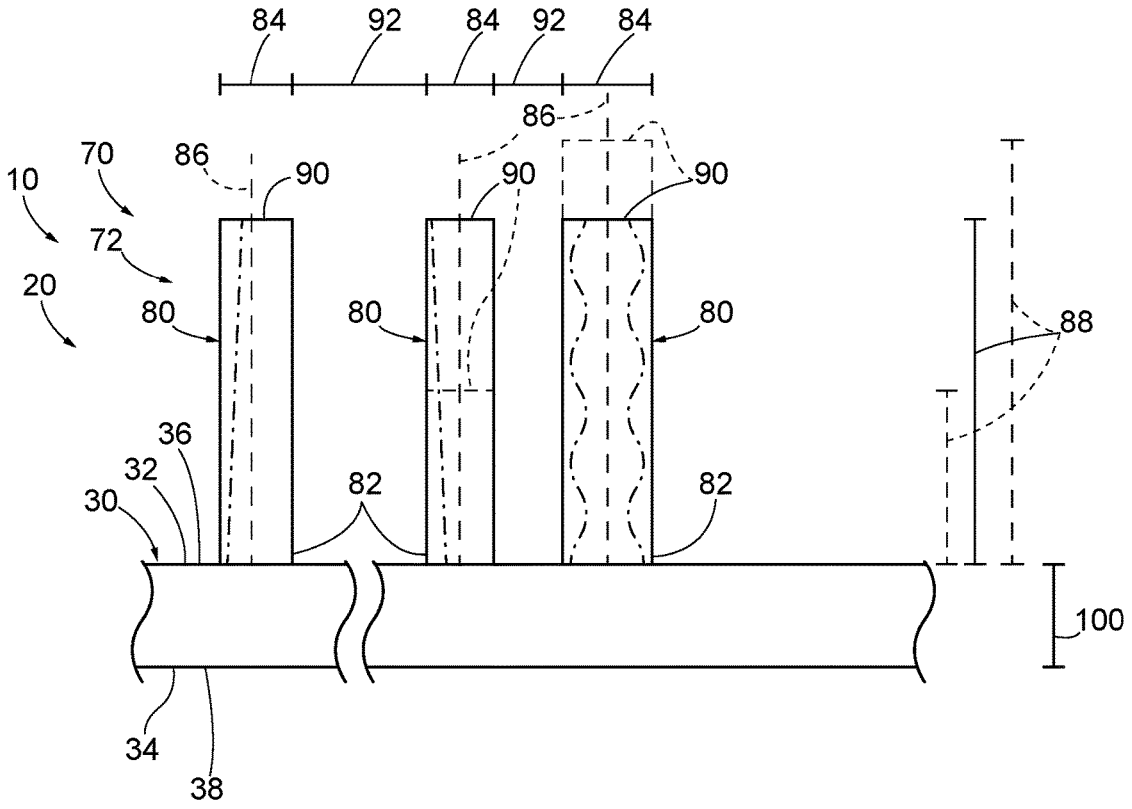
FIG. 5 is a fragmentary detail illustrating examples of relative shapes and configurations of force-absorbing resilient fingers on a projecting surface of a resilient rib of a tossing ball according to the present disclosure.

In FIG. 5, a portion of a rib 30 and three fingers 80 of a tossing ball 10 are schematically illustrated to provide examples of relative shapes, sizes, and spacing of the force-absorbing resilient fingers 80 on a rib 30. The schematic examples of FIG. 5 may be applied to any of the fingers 80, ribs 30, bodies 20, and/or tossing balls 10 described and/or illustrated herein. As shown, rib 30 has a rib thickness 100 that is measured between opposed outwardly and inwardly facing surfaces 32 and 34 of the rib. Although illustrated schematically in FIG. 5 as being flat, or linear, for ease of illustration, it should be understood that the interconnected resilient ribs 30 of an assembled play ball 10 typically will have curved, or arcuate, shapes as the rib extends between nodes 60 of the play ball. Similarly, fingers 80 that extend from a projecting surface 36 of a rib of an assembled play ball 10 typically will diverge from each other as the fingers extend outwardly away from internal volume 40 of tossing ball 10 and typically will converge toward each other and/or intersect with each other as the resilient fingers extend into internal volume 40.

As shown in FIG. 5, each of the illustrated fingers 80 has a base 82 that extends from the projecting surface 36 of the rib. Base 82 additionally or alternatively may be referred to as a finger base 82 and/or as being connected to the rib and/or to the projecting surface of the rib. Finger base 82 has a transverse dimension 84 that is measured transverse to the longitudinal axis 86 of the finger, and a length 88 that is measured along the longitudinal axis from where finger base 82 extends from projecting surface 36 to a distal end 90 of the finger. When finger 80 has a circular cross-sectional shape measured transverse to longitudinal axis 86, the transverse dimension corresponds to the diameter of the finger.

In FIG. 5, each of the illustrated examples of fingers 80 have lengths 88 that are greater than the thickness 100 of rib 30 and that are greater than the distance between the adjacent fingers 80. When the fingers 80 have lengths 88 that are greater than the thickness 100 of the rib 30 from which the fingers extend, the finger lengths 88 may be at least two times, at least three times, at least five times, and/or at least ten times greater than the thickness of rib 30. It is within the scope of the present disclosure that some or even all of fingers 80 may have a length 88 that is the same as or less than the thickness of rib 30 and/or the distance between adjacent fingers 80. Examples of suitable lengths 88 for force-absorbing resilient fingers 80 include lengths that are at least one of at least 0.5 cm, at least 1 cm, at least 1.5 cm, at least 2 cm, at least 3 cm, at least 4 cm, at least 5 cm, at least 6 cm, at least 7 cm, less than 15 cm, less than 10 cm, less than 7.5 cm, less than 5 cm, in the range of 0.5-3 cm, in the range of 1.5-5 cm, and/or in the range of 2.5-7.5 cm.

As also schematically illustrated in FIG. 5 with dash-dot lines, a finger 80 may have a constant or variable transverse dimension 84 along the longitudinal axis 86 of the finger. Examples include fingers 80 that have constant transverse dimensions, fingers 80 that have transverse dimensions that decrease as the finger extends away from base 82, fingers that have transverse dimensions that increase as the finger extends away from base 82, and fingers that have transverse dimensions that sequentially increase and decrease (in either order) as the finger extends away from base 82. Fingers that increase or decrease in transverse dimension along the length of the finger may do so in any suitable relative and/or incremental amounts, including fingers with transverse dimensions that increase or decrease in size about or offset from the longitudinal axis of the finger. Referring briefly back to FIG. 1, fingers 80 according to the present disclosure optionally may individually or collectively define closed perimeters, such as by adjacent fingers 80 including a spanning portion 94 that interconnects the fingers and/or by a finger 80 including a ring, or closed-loop, region 96. When present, spanning portion 94 and/or closed-loop region 96 may be located at any suitable location along the length of the corresponding finger(s), with examples including at the distal end region or at an intermediate position between the base and distal end region of the corresponding finger(s).

The bases 82 of adjacent fingers 80 are separated by a distance 92, which additionally or alternatively may be referred to as a finger spacing 92. As illustrated schematically in FIG. 5, finger spacing 92 may be less than, equal to, or greater than the transverse dimension of the fingers' bases and/or than the thickness 100 of rib 30. Also, the finger spacing 92 between a finger 80 and the closest adjacent finger 80 of a plurality 72 of force-absorbing resilient fingers 80 may be constant for all of the fingers of the plurality 72 of force-absorbing resilient fingers 80, or it may be different for at least a subset of the plurality 72 of force-absorbing resilient fingers 80 of a rib 30. Examples of suitable finger spacings 92 between a finger 80 on a projecting surface 36 of a rib 30 and the closest adjacent finger 80 on the projecting surface 36 of the rib include spacings 92 of at least 0.05 cm, 0.1 cm, at least 0.2 cm, at least 0.3 cm, at least 0.4 cm, at least 0.5 cm, at least 1 cm, at least 1.5 cm, at least 2 cm, at least 2.5 cm, less than 5 cm, less than 4 cm, less than 3 cm, less than 2 cm, less than 1.5 cm, less than 1 cm, less than 0.75 cm, less than 0.6 cm, less than 0.4 cm, less than 0.25 cm, less than 0.1 cm, in the range of 0.1-0.5 cm, in the range of 0.2-1 cm, in the range of 0.5-2 cm, and/or in the range of 0.75-2.5 cm.

As depicted by comparing the fingers 80 shown in solid lines in FIG. 5 to other fingers that are shown in solid lines and/or to fingers that are shown in dashed lines or a combination of dashed and solid lines in FIG. 5, the fingers 80 of a plurality 72 of fingers of a rib 30 may have the same or different lengths 88, transverse dimensions 84, and/or spacings. As examples, a plurality 72 of force-absorbing resilient ribs 80 may be sized so that adjacent ribs have different lengths, such as to gradually increase in length and then decrease in length, or such as to alternate between two or more repeating finger lengths. As other examples, a plurality 72 of force-absorbing resilient fingers 80 may be sized so that adjacent ribs have the same length and the same or different transverse dimensions. As still further examples, the finger spacing 92 between adjacent fingers 80 of a plurality of force-absorbing resilient fingers 80 of a rib 30 may be the constant or may vary between at least a subset of immediately adjacent fingers 80.

Figure 6:
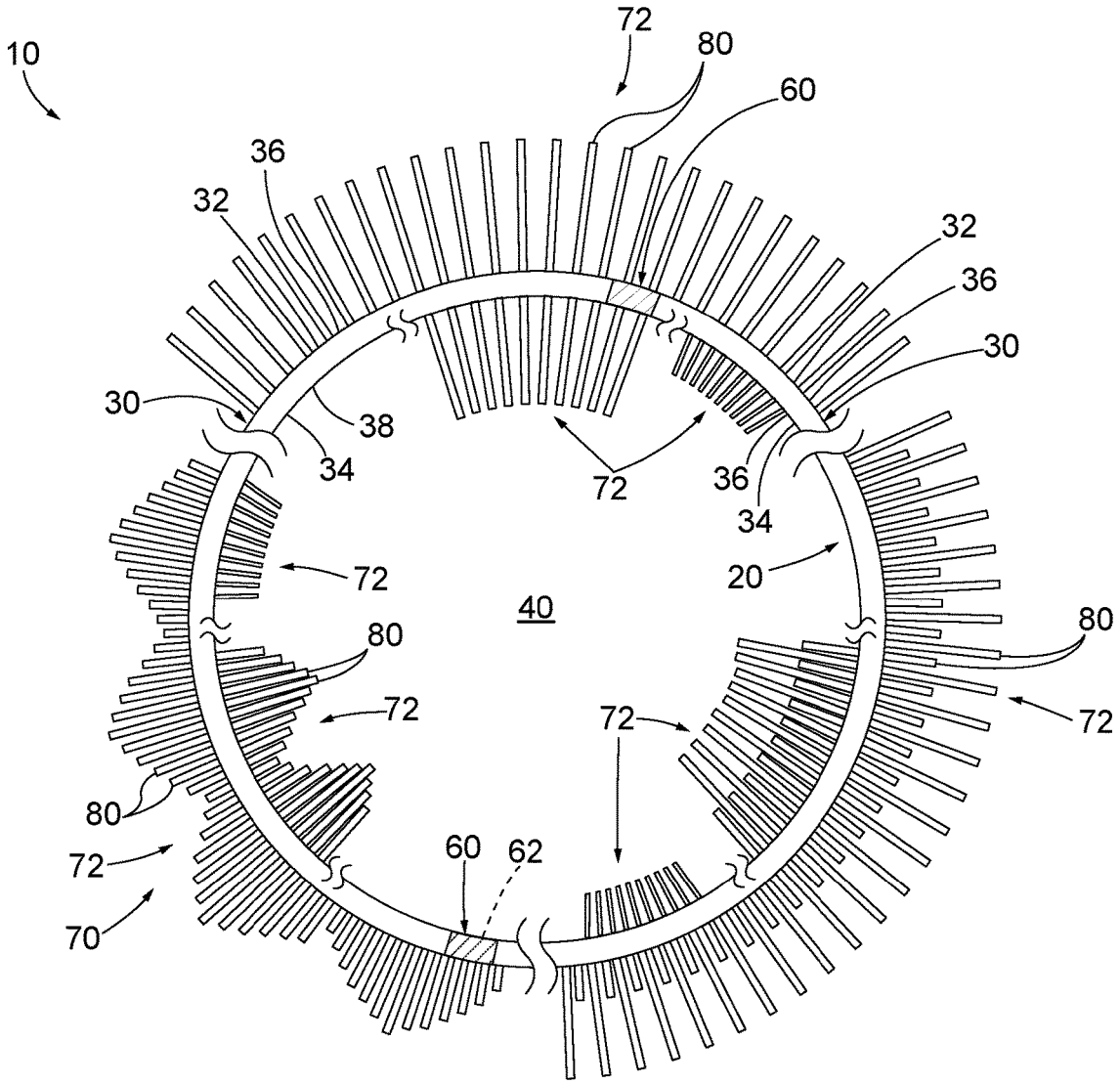
FIG. 6 is a fragmentary cross-sectional view of the tossing ball of FIG. 1 illustrating examples of configurations for force-absorbing resilient fingers for tossing balls according to the present disclosure.

FIG. 6 provides additional examples of suitable relative sizes and configurations for the array 70 and plurality(ies) 72 of force-absorbing resilient fingers 80 that extend from projecting surfaces 36 of ribs 30 of tossing balls 10. In FIG. 6, a pair of ribs 30 and a corresponding pair of nodes 60 at which the ribs are interconnected are somewhat schematically illustrated. The examples of FIG. 6 may be applied to any ribs 30 that are described and/or illustrated herein regardless of the shape and/or configuration of the ribs 30, the number of ribs that are interconnected at a node 60, and/or the structure of the node.

The graphically illustrated examples of FIG. 6 include ribs 30 that include one projecting surface 36 and one contact surface 38, ribs 30 that include first and second opposed contact surfaces 38, ribs 30 that include a projecting surface 36 on an outwardly facing surface 32 of the rib, ribs 30 that include a projecting surface 36 on an inwardly facing surface 34 of the rib, ribs 30 that include fingers 80 having constant lengths, ribs 30 that include fingers 80 having alternating longer and shorter lengths, ribs 30 that include fingers of sequentially increasing and/or decreasing lengths, and ribs 30 that have shorter, fewer, and/or more fingers on an inwardly facing projecting surface than on an outwardly projecting surface.

In FIGS. 1-4 and 6, the plurality of interconnected resilient ribs 30 have been illustrated as being curved ribs 30 in which each rib 30 includes opposed and/or otherwise spaced apart end regions that are interconnected at nodes 60 to the corresponding end regions of the other ribs 30 of the plurality of interconnected resilient ribs. The illustrated nodes 60 of FIGS. 1-4 are aligned on an axis, which may be a central, major, minor, and/or longitudinal axis, of the tossing ball 10. As discussed, however, FIGS. 1-2 also are intended to schematically depict tossing balls 10 according to the present disclosure and thus may be described as graphically representing that tossing balls 10, bodies 20, ribs 30, nodes 60, and/or fingers 80 may have a variety of shapes, sizes, and configurations. It thus is within the scope of the present disclosure that all of the ribs, nodes, and/or fingers may have the same properties, that some of the ribs, nodes, and/or fingers may have one or more different properties than others of the ribs, nodes, and/or fingers, and that all of the ribs, nodes, and/or fingers may have one or more different properties. Examples of these properties include thickness, size, curvature, resiliency, materials of construction, elasticity, length, width, and/or color. When described in the context of a particular component of a tossing ball 10, the properties may be identified accordingly, such as being a rib property, a node property, a finger property, etc.

Figure 7:
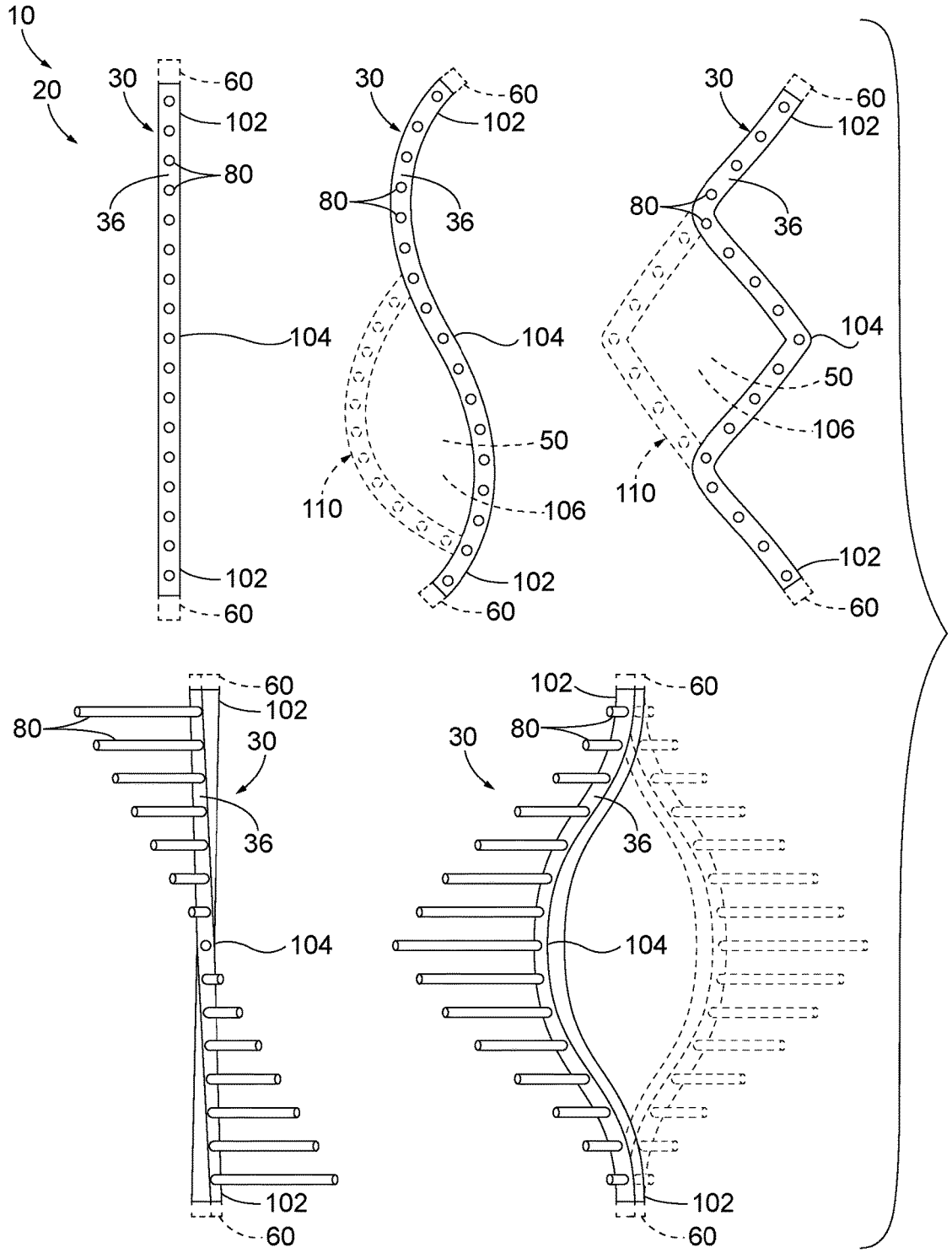
FIG. 7 is a fragmentary top plan view illustrating examples of configurations for resilient ribs for tossing balls according to the present disclosure.

FIG. 7 provides additional examples of suitable shapes for ribs 30 for play balls 10 according to the present disclosure. For ease of illustration, the examples shown in FIG. 7 are illustrated as being flat, but it should be understood that such ribs will have a curved shape when their ends 102 are connected at one or more nodes of a tossing ball 10 to form a plurality of interconnected resilient ribs 30 according to the present disclosure. The ribs 30 shown in FIG. 7 may be described as being double-ended ribs 30, double-ended resilient ribs 30, and/or double-ended force-absorbing resilient ribs 30 because each rib includes spaced-part ends 102 that are separated by an elongate central region 104 of the rib. Ends 102 additionally or alternatively may be referred to as rib ends 102, terminal ends 102, and/or node-contacting ends 102.

From left to right in FIG. 7, the examples of ribs 30 include a straight rib, an arcuate rib, a zigzag rib, a spiral rib, and a bistable rib. In a linear rib 30, and when assembled as part of a tossing ball 10, the plurality of force-absorbing resilient fingers 80 on a projecting surface 36 of the straight rib may extend in a single plane that intersects the ends 102 of the rib. In contrast, in the examples of an arcuate rib, a zigzag rib, a spiral rib, and a bistable rib shown in FIG. 7, the plurality of force-absorbing resilient fingers may not extend in a single plane that intersects the ends of the rib from which the plurality of force-absorbing resilient fingers extends.

In an arcuate rib 30, the rib defines an arcuate shape between its ends 102, but without acute apexes or corners. A variant of the illustrated arcuate rib 30 shown in FIG. 7 is an arcuate rib in which the projecting surface undulates (i.e., extends closer and farther from the center of a tossing ball) along the length of the rib. In the context of the "flat" example shown in FIG. 7, the projecting surface of an undulating rib may be described as extending out of and into the page. An arcuate rib 30 additionally or alternatively may be referred to as a wavy rib 30, a curved rib 30, a serpentine rib 30, an undulating rib 30, and/or an S-shaped rib 30. In a zigzag rib 30, the rib includes a plurality of acute apexes or corners along its central region 104 between ends 102. A zigzag rib 30 additionally or alternatively may be referred to as a stepped rib 30, a lightning-shaped rib 30, and/or a corned rib 30.

In a spiral rib 30, the rib twists along the length of the rib, thereby resulting in the projecting surface 36 of the rib rotating along the length of the rib. As shown in FIG. 7, this results in the plurality of force-absorbing resilient fingers 80 of the rib projecting in different radial directions along the length of the rib. A spiral rib 30 additionally or alternatively may be referred to as a coiled rib 30, a helical rib 30, and/or a twisted rib 30.

A bistable rib 30 is selectively configured between two distinct stable positions that do not require a user to apply force to the rib to retain the rib in either of these stable positions. Instead, the user simply urges the rib from one stable position to the other stable position, such as by pushing upon, pulling, and/or twisting a central region 104 of the rib relative to the ends 102 of the rib. Both bistable configurations of a bistable rib 30 may be obtained when the tossing ball is in its nominal configuration.

Figure 8:
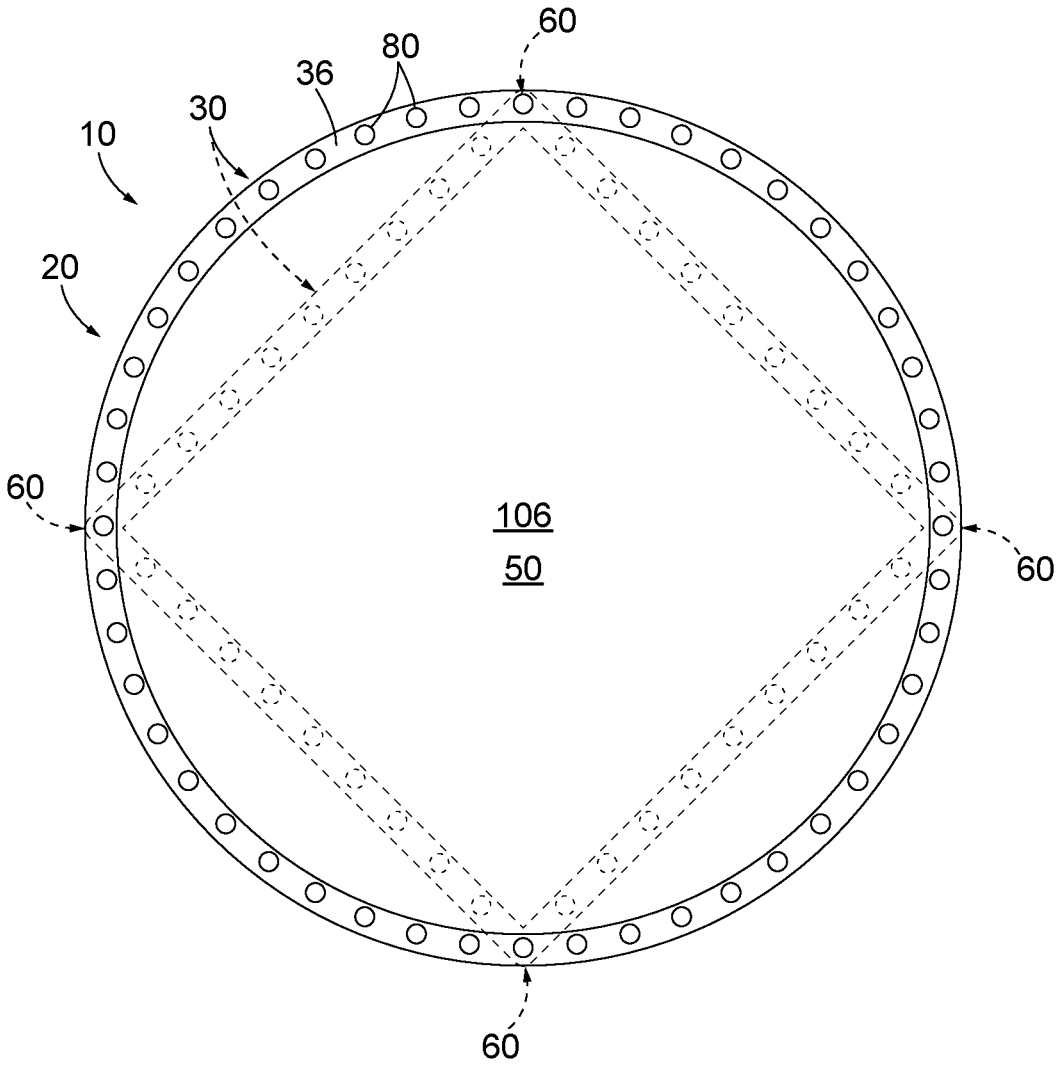
FIG. 8 is top plan view illustrating examples of configurations for resilient ribs for tossing balls according to the present disclosure.

FIG. 8 provides additional examples of suitable shapes for ribs 30 of play balls 10 according to the present disclosure. For ease of illustration, ribs 30 of FIG. 8 also are illustrated as being flat, but such ribs may not be flat in an assembled tossing ball 10. For example, the ribs may have twists, undulations, and/or bent regions when forming part of an assembled tossing ball 10. In contrast to the double-ended ribs of FIG. 7, the ribs 30 of FIG. 8 may be referred to as ring-shaped ribs 30, closed-loop ribs 30, and/or as continuous ribs 30 (i.e., without distinct rib ends). Ring-shaped ribs 30 include a projecting surface 36 that defines a continuous, or closed, perimeter that surrounds, or bounds, a central ring opening 106. In an assembled tossing ball 10, central ring opening 106 also forms a passage 50, as indicated in FIG. 8. Ring-shaped rib 30 is shown in solid lines as having a circular shape (and/or a circular projecting surface 36). It is within the scope of the present disclosure that ring-shaped ribs may have any suitable regular or irregular geometric shape that defines a closed perimeter with a central ring opening. This is schematically illustrated in FIG. 8 in dashed lines with a rectangular ring-shaped rib 30. Additional examples include ring-shaped ribs having triangular, elliptical, ovoid, square, rhombic, pentagonal, hexagonal, heptagonal, octagonal, etc. shapes. Referring briefly back to FIG. 7, dashed lines are utilized with respect to arcuate rib 30 and zigzag rib 30 to somewhat schematically illustrate that it is within the scope of the present disclosure that any double-ended ribs 30 optionally also may include a closed-loop, or ring-shaped, region 110 that defines a ring opening 106, which also may form a passage 50 of the plurality of passages.

For each of the ribs 30 shown in FIGS. 7 and 8 a representative number of fingers 80 have been depicted, but the fingers 80 may have any finger properties, relative number, etc. as is described and/or illustrated herein, including in connection with FIGS. 1, 5, and 6. Also, for simplicity, only a single projecting surface 36 is shown, but the ribs may include a pair of opposed projecting surfaces, as described herein.

The plurality of interconnected ribs 30 of a play ball 10 all may have the same properties, such as the six straight ribs 30 shown in FIGS. 1-4. Alternatively, one or more of the ribs 30 may have one or more different properties as one or more other ribs of the plurality of interconnected ribs 30 of a play ball 10. For example, some of the plurality of interconnected ribs may have a first shape and at least one of the other ribs of the plurality of interconnected ribs may have a second shape that is different than the first shape. When arcuate, zigzag, and/or spiral ribs are included in a tossing ball, the ribs of the plurality of interconnected resilient ribs all may have the same relative node-to-node orientation, or at least one of the ribs may have a different relative orientation. As examples, the rib may twist or bend in opposite relative directions than an adjacent rib.

As discussed, a node 60 represents a region, component, and/or structure of the portion of a tossing ball 10 (and/or resilient skeletal body 20 thereof) where two or more of the plurality of interconnected ribs 30 are interconnected. At a node 60, the interconnected portions of ribs 30 may be directly connected, such as integrally and/or in an abutting relationship, or indirectly when a separate coupler, or coupling structure, 62 is utilized to interconnect the portions of the ribs. Coupler 62 additionally or alternatively may be referred to herein as a rib coupler 62. The interconnected portions of ribs 30 may be the ends 102 of the ribs, but this is not required to all embodiments. For example, it also is within the scope of the present disclosure that an end 102 of one or more ribs 30 may be interconnected at a node 60 with a central region 104 of one or more other ribs 30. As another example, central regions 104 of two or more ribs 30 may be interconnected at a node 60.

Figure 9:
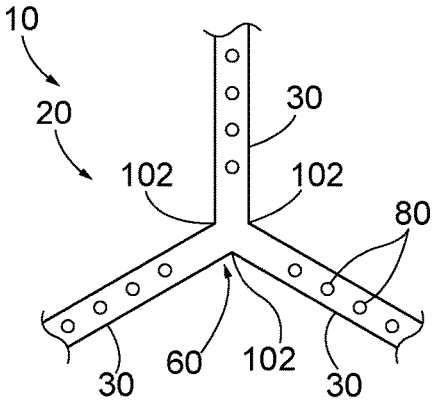
FIG. 9 is a fragmentary top plan view illustrating an example of a node for tossing balls according to the present disclosure.
Figure 10:
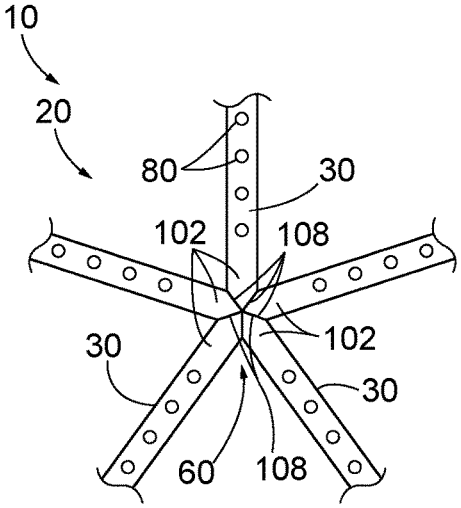
FIG. 10 is a fragmentary top plan view illustrating an example of a node for tossing balls according to the present disclosure.

FIGS. 9-12 are fragmentary views illustrating examples of nodes 60 according to the present disclosure, as well as examples of portions of tossing balls 10 with different numbers of ribs 30 forming the plurality of interconnected ribs. The examples of FIGS. 9-12 are intended to provide examples of nodes that may be used with any of the tossing balls 10 described and/or illustrated herein. FIG. 9 illustrates that ribs 30 maybe integrally formed and thus monolithically interconnected when the rest of resilient skeletal body 20 of a tossing ball 10 is formed. FIG. 10 illustrates that the ribs, or at least one end 102 thereof, may be discrete components that are interconnected at a node 60 after formation of the ribs. As an example, the ends 102 may be adhered, welded, chemically bonded, thermally bonded, fused, and/or otherwise secured together at a bond 108. The bond thus may be formed from the same material as ribs 30 and/or ends 102 thereof, or the bond may be formed from an adhesive, resin, or other bonding agent that is applied and thereafter cured to secure the ends or other regions of ribs 30 together to form node 60.

Figure 11:
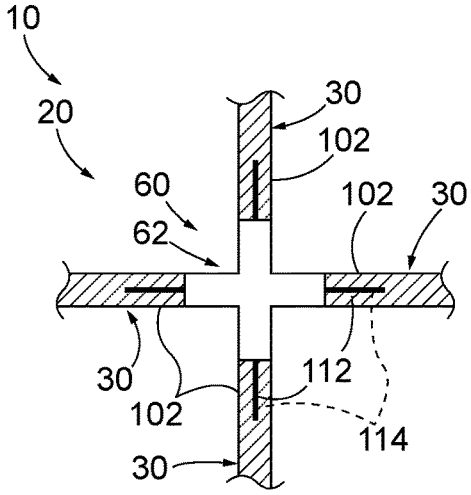
FIG. 11 is a fragmentary top plan view illustrating an example of a node with a coupler for tossing balls according to the present disclosure.
Figure 12:
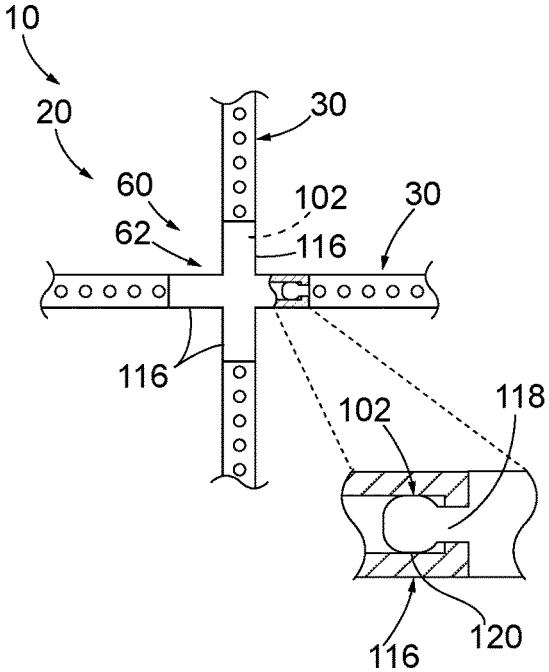
FIG. 12 is a fragmentary top plan view illustrating an example of a node with a coupler for tossing balls according to the present disclosure.

FIGS. 11 and 12 illustrate examples of nodes 60 that take the form of separate structural elements of tossing balls 10 to which the ends 102 or other regions of ribs 30 are selectively physically coupled to interconnect the ends or other regions of the ribs. These separate structural elements may be referred to herein as couplers 62. Couplers 62 may be described as mechanically interconnecting two or more ribs 30, such as by mechanically interconnecting ends 102 of two or more ribs. Couplers may be formed from the same material as ribs 30, but couplers alternatively may be formed from a different material than ribs 30. When formed from a different material, this material may be less resilient, less elastic, denser, harder, and/or more rigid than the material from which ribs 30 are formed.

In the example of FIG. 11, coupler 62 includes pins 112 that are configured to be inserted into ribs 30 to interconnect the ribs at node 60. As illustrated, pins 112 are shown inserted into ends 102 of ribs 30, although it is within the scope of the present disclosure that pins 112 may be inserted into other regions of ribs 30, such as a central region of one or more of the ribs. Ends 102 (or other portions of ribs 30 that are configured to receive a pin 112) may have a preformed bore 114 that is sized and/or otherwise configured to receive and selectively retain pin 112. Alternatively, pin 112 may be configured to puncture rib 30 to interconnect the rib with the coupler.

In the example of FIG. 12, coupler 12 includes sockets, or receivers, 116 that are configured to receive and retain ends 102 of ribs 30 to interconnect the ends at node 60. As illustrated, sockets 116 include a neck 118, and ends 102 include a head 120 that has a cross-sectional dimension that is larger than the opening defined by neck 118 to assist with retaining of the end within the socket after the head has been pushed or otherwise inserted through the neck 118. It also is within the scope of the present disclosure that a rib 30 may include a head 120 on one or more other regions of the rib (such as central region 104) to thereby configure these other regions to be selectively interconnected to coupler 62 to form a node 60.

Once a coupler 62 is used to interconnect ribs 30 at a node 60, the ribs may or may not be configured to be selectively removed from and optionally recoupled to the coupler without damage to the rib and/or coupler. Thus, some couplers may be configured for one-time use, while others are configured to permit selective and repeated coupling and removal of the portions of ribs 30 without damage to the ribs or coupler.

As discussed, tossing balls 10 may include two or more nodes 60, and the nodes may have the same or different properties and/or structures. As an example, all of the nodes may be integrally formed portions of the ribs. As another example, at least one of the nodes 60 may be integrally formed portions of the ribs, and at least one of the nodes may be adhered portions of the ribs. As another example, at least one of the nodes 60 may be integrally formed portions of the ribs, and at least one of the nodes may be or include a coupler. As yet another example, at least one of the nodes may be adhered portions of the ribs, and at least one of the nodes may be or include a coupler. As still another example, all of the nodes may be adhered portions of the ribs. As another example, all of the nodes may be or include couplers. In the latter example, tossing ball 10 optionally may be used and/or packaged as a kit that includes a plurality of ribs and a plurality of couplers, and a user may selectively interconnect the plurality of ribs using the couplers to form tossing ball 10. Such a user-constructed tossing ball also may add play value by enabling a user to select from an excess number of ribs (i.e., more than are required to form tossing ball 10) to form a user-customized tossing ball 10.

Figure 13:
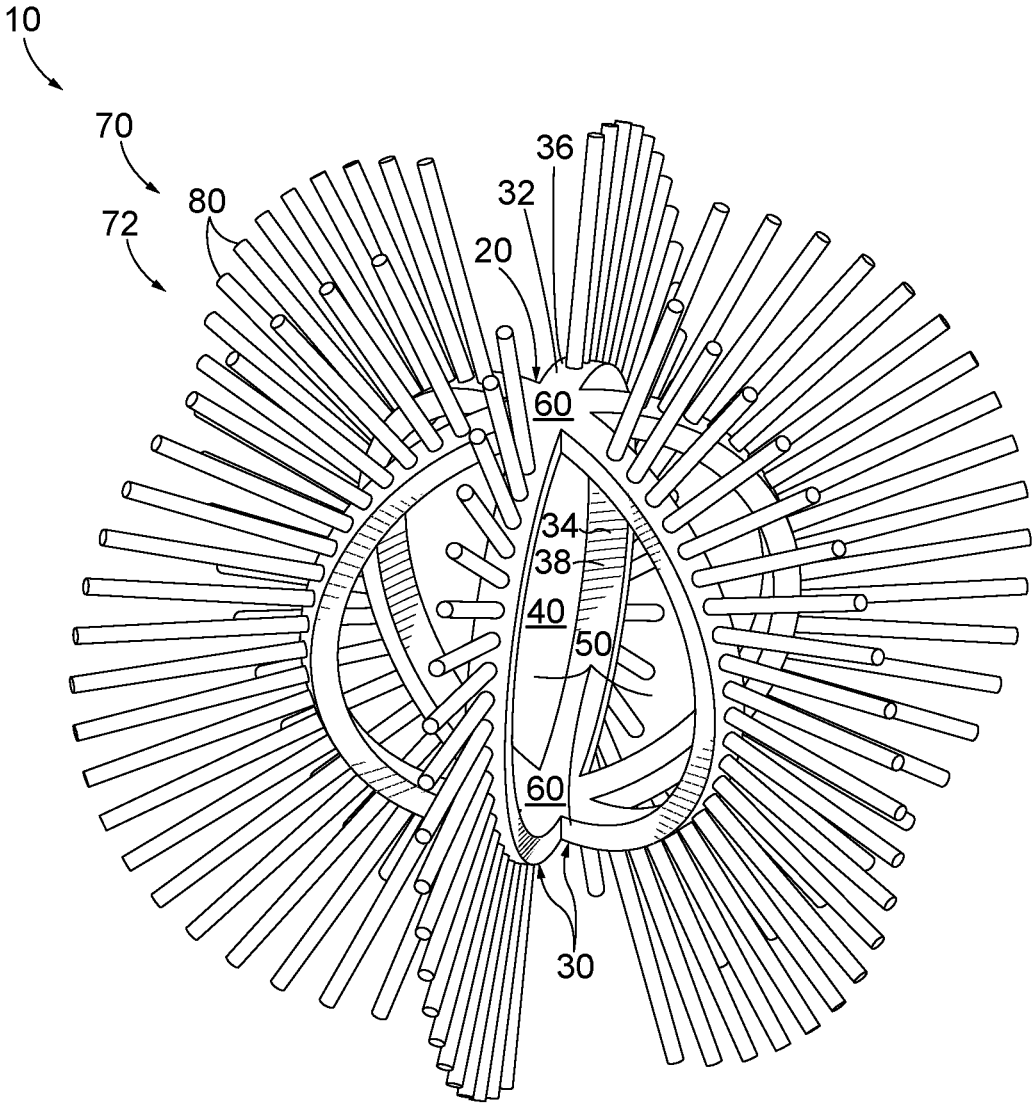
FIG. 13 is an isometric view of an example of a tossing ball according to the present disclosure in a nominal configuration.
Figure 14:
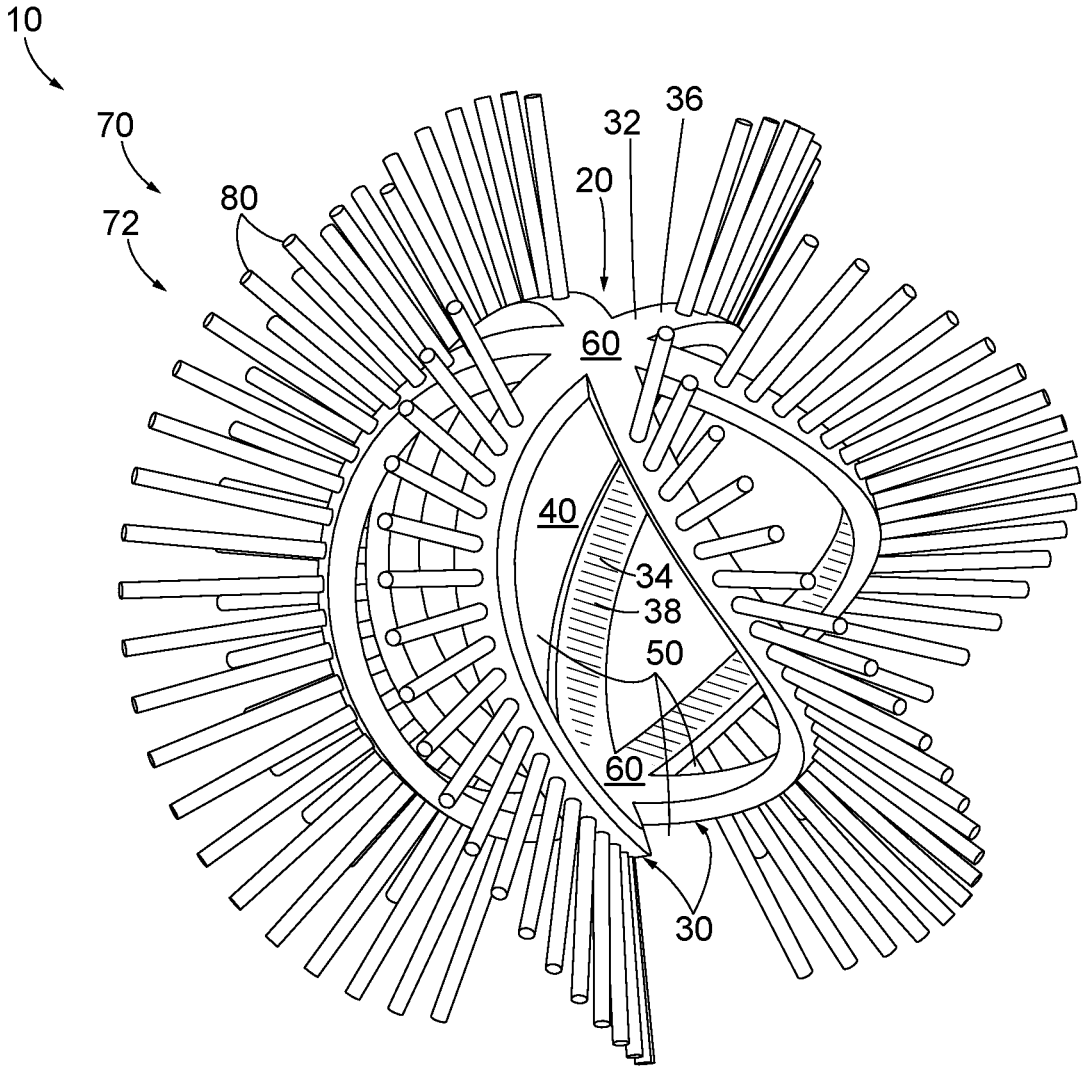
FIG. 14 is an isometric view of an example of a tossing ball according to the present disclosure in a nominal configuration.
Figure 15:
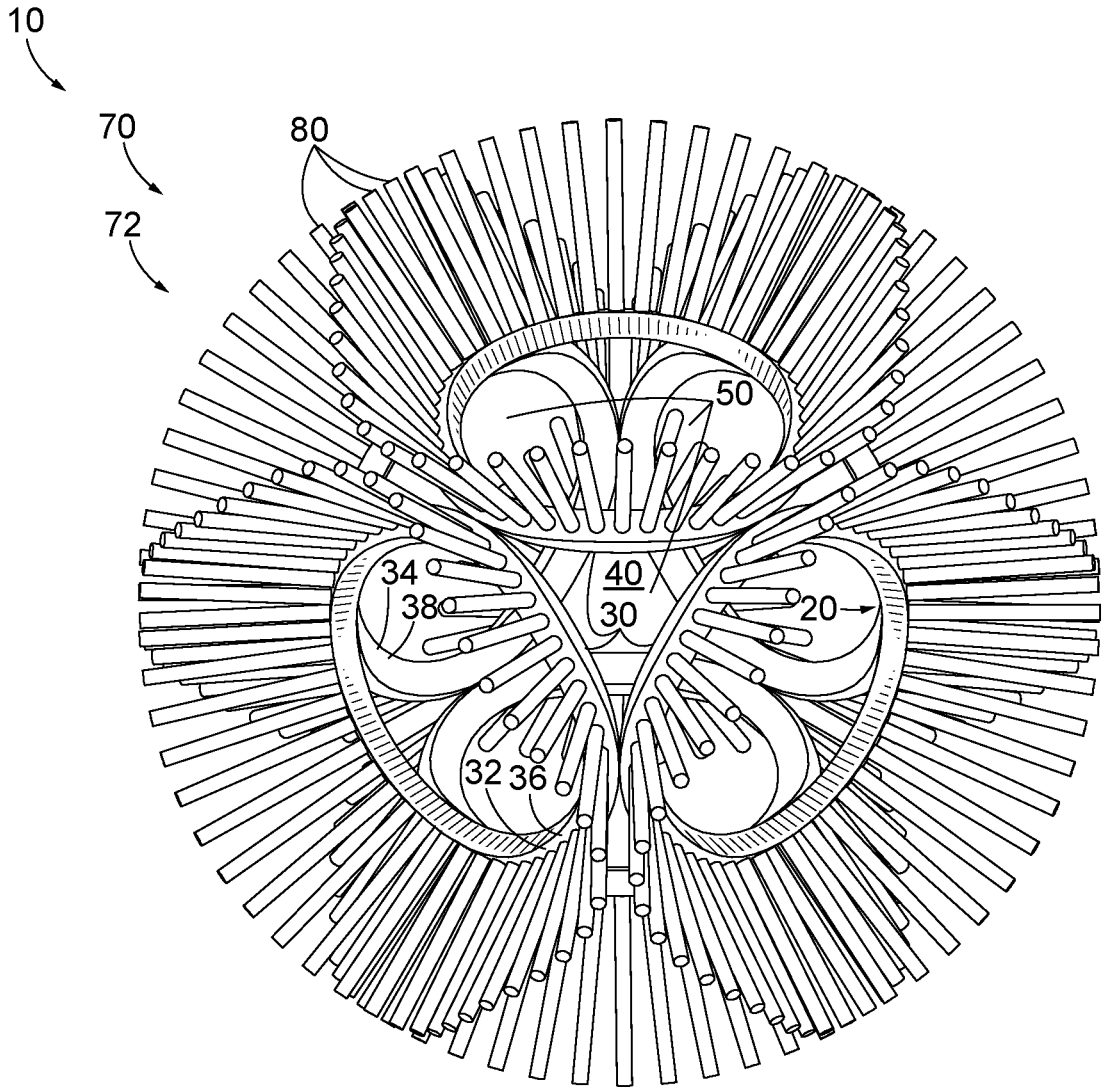
FIG. 15 is an isometric view of an example of a tossing ball according to the present disclosure in a nominal configuration.

FIGS. 13-15 provide additional examples of tossing balls 10 according to the present disclosure. The illustrated balls include specific implementations of the features, properties, components, and characteristics of play balls 10 described herein. FIG. 13 provides an example of a tossing ball with six straight ribs 30. FIG. 14 provides an example of a tossing ball 10 with six arcuate ribs 30. FIG. 15 provides an example of a tossing ball 10 with six ring-shaped ribs 30. Thus, the tossing balls 10 of FIGS. 13-15 are presented as specific examples of the much larger number of potential combinations of these features, properties, components, and characteristics.

FIGS. 13-15 include representative ones of the reference numerals described herein and utilized in one or more of FIGS. 1-12, but not all reference numerals are included so as to increase the visibility of the structure shown in FIGS. 13-15. Despite this simplification, any of the features, components, and characteristics described herein may be utilized in the tossing balls of FIGS. 13-15, or variants thereof, without departing from the scope of the present disclosure. Examples include differences in the finger properties, changes in the number of ribs 30, changes in the type and/or locations of nodes 60, and/or the inclusion of a second plurality of force-absorbing resilient fingers 80 in the inwardly facing surface of the tossing balls.

Figure 16:
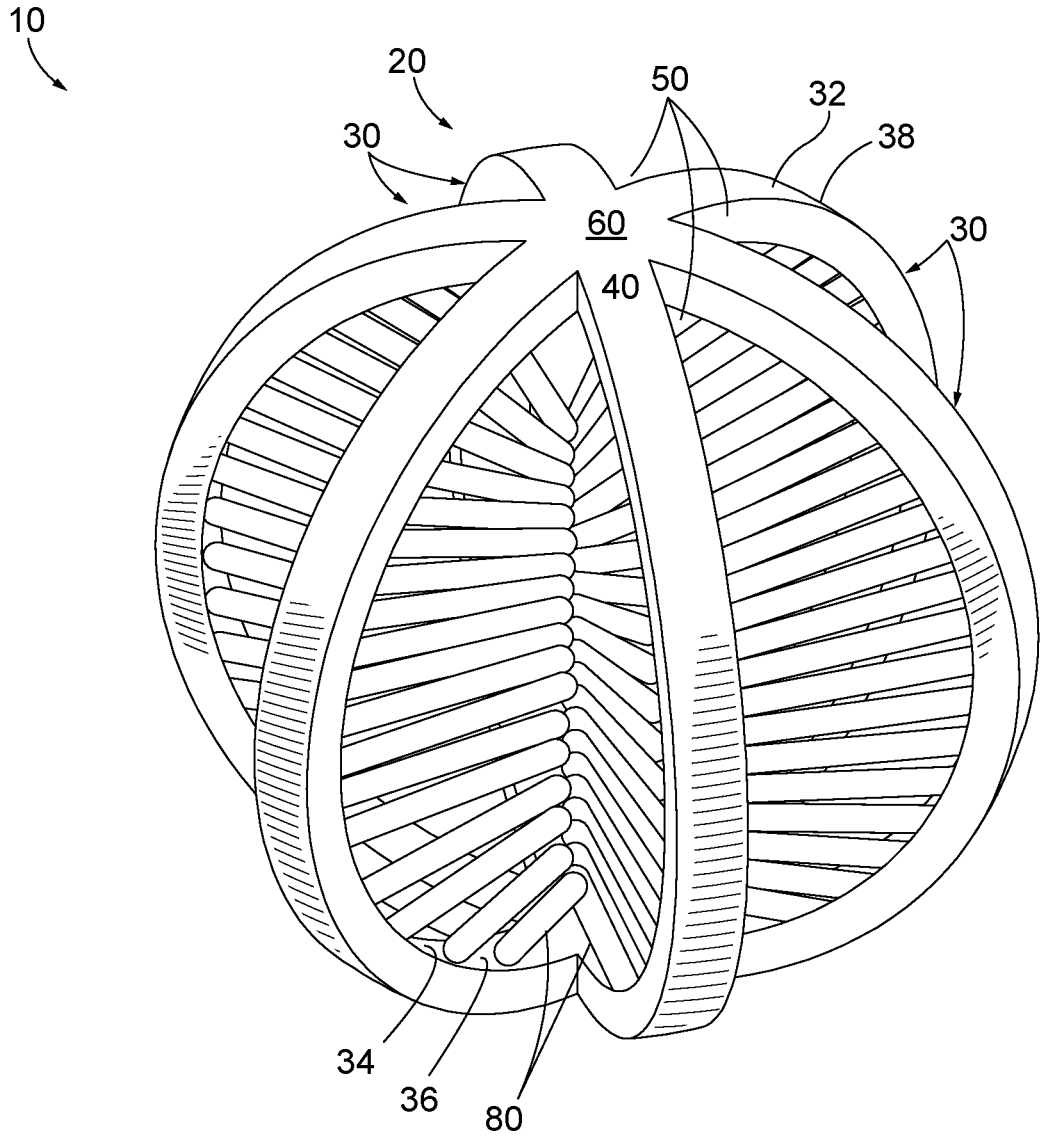
FIG. 16 is an isometric view of the tossing ball of FIG. 13 in an everted configuration.
Figure 17:
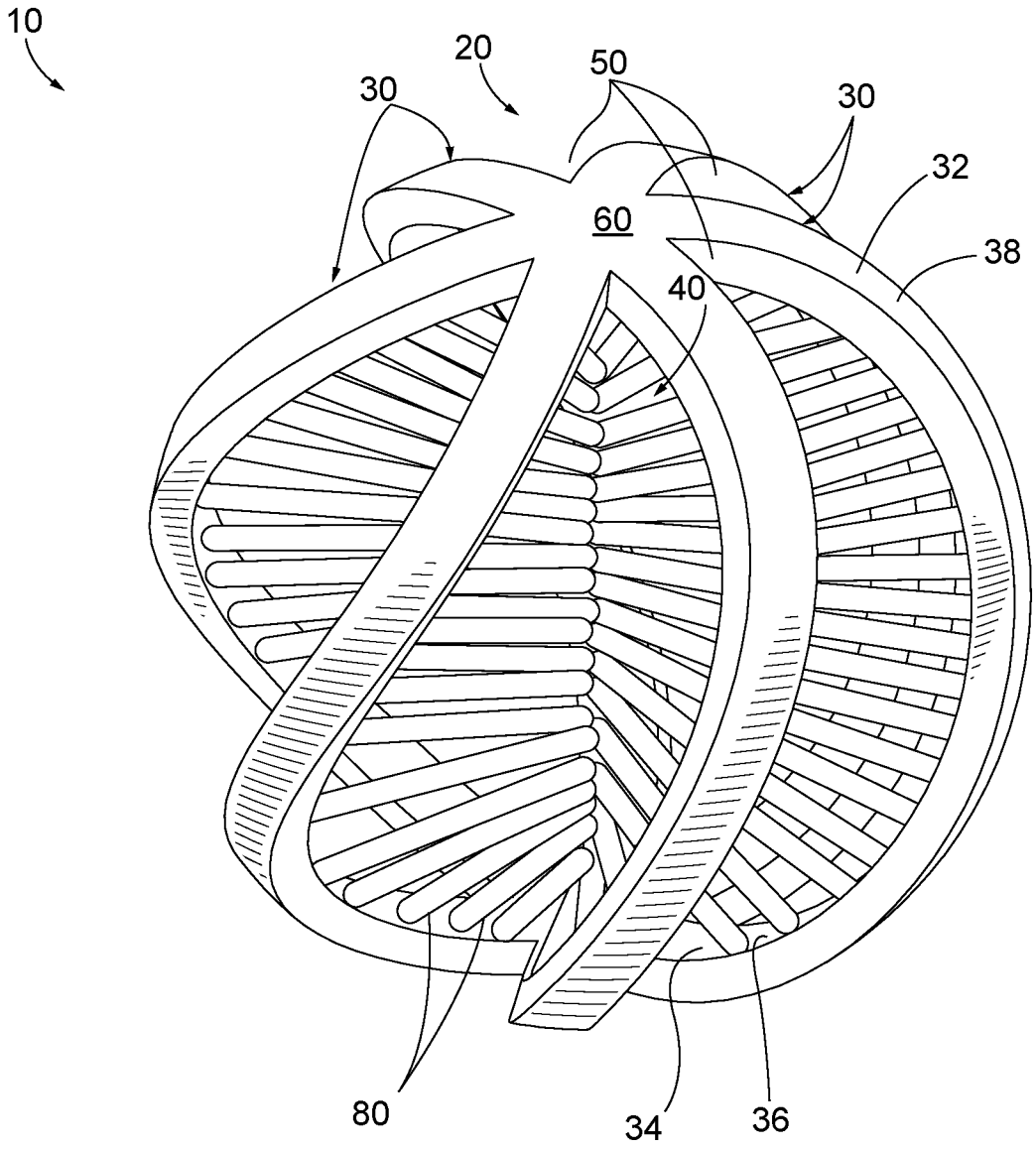
FIG. 17 is an isometric view of the tossing ball of FIG. 14 in an everted configuration.
Figure 18:
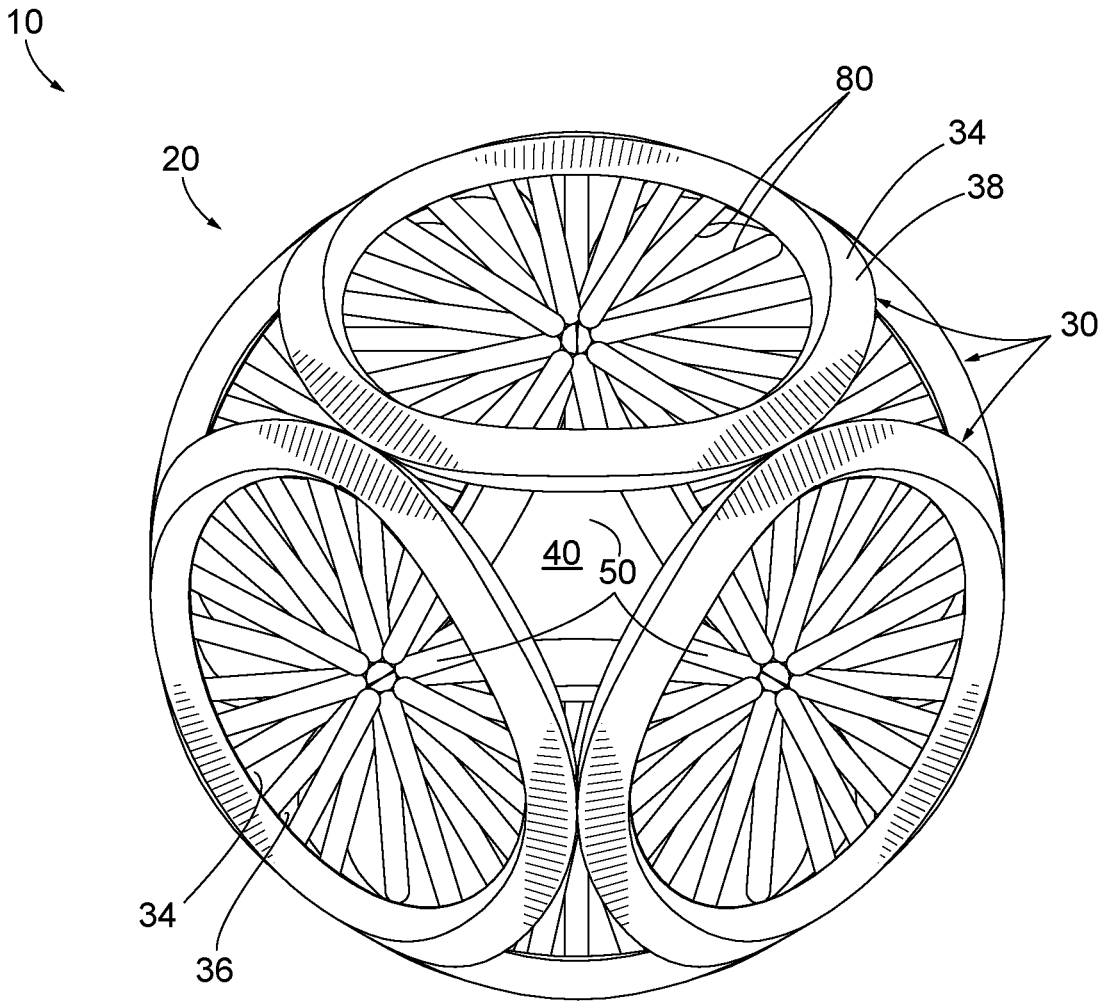
FIG. 18 is an isometric view of the tossing ball of FIG. 15 in an everted configuration.

Some tossing balls 10 according to the present disclosure are everting tossing balls in which the ball may be selectively and non-destructively everted (i.e., turned inside-out) so that the outwardly facing surfaces 32, 22 of the plurality of interconnected ribs 30 and/or resilient skeletal body 20 become the inwardly facing surfaces 34, 24 of the plurality of interconnected ribs 30 and/or resilient skeletal body 20, and vice versa. Such tossing balls 10 additionally or alternatively may be referred to herein as everting tossing balls 10, reversible tossing balls 10, and/or inside-out tossing balls 10. The configuration of an everting tossing ball 10 after being everted from its nominal configuration may be referred to as the everted configuration of the tossing ball. It also is within the scope of the present disclosure that the nominal and everted configurations additionally or alternatively may be referred to as first and second configurations and/or as primary and secondary configurations. FIGS. 16-18 depict the tossing balls 10 of FIGS. 13-15, respectively, that have been everted from the nominal configuration of FIGS. 13-15 to the everted configuration of FIGS. 16-18.

To be an everting tossing ball 10, the ball is configured to be reversibly everted without destruction or disassembly of any portion of the tossing ball 10. Thus, unlike some toys that may be disassembled and reassembled in an everted configuration, an everting tossing ball 10 may be selectively and reversibly everted without destruction or disassembly of any portion of the tossing ball. For example, when a user wants to evert the tossing ball 10 of FIG. 1, the user may simply grasp one or more of the ribs 30 and pull or push the rib(s) through internal volume 40 and through one of passages 50 on an opposed side of the ball. The user then may roll, push, pull, or otherwise manipulate the remainder of the ball until the ball is everted, with the surfaces that were outwardly facing surfaces in the ball's nominal configuration now being inwardly facing surfaces, and vice versa. It follows then that a plurality of force-absorbing resilient fingers that extends away from the open central region of the tossing ball when the ball is in its nominal configuration will extend into the open internal volume when the tossing ball is in its everted configuration.

Resilient skeletal bodies 20 of everting tossing balls 10 may have different geometric shapes in the nominal configuration and the everted configuration. Thus, the resilient skeletal body may be described as having a first shape when the tossing ball is in its nominal configuration and a second geometric shape, which is different than the first geometric shape, when the tossing ball is in its everted configuration. As examples, a first one of the first geometric shape and the second geometric shape may be one of spherical, elliptical, ovoid, a spheroid, and an ellipsoid, and the other one of the first shape and the second shape may be cubic, tetrahedral, pyramidal, hexahedral, octahedral, decahedral, and dodecahedral. As used herein with respect to the shapes of the tossing balls when in their nominal and/or everted configurations, references to these shapes should be construed also to include shapes that are at least generally or at least substantially the indicated shape, as the resilient nature, nodes, and/or other properties of the tossing balls may not produce an exact shape.

When in an everted configuration, an everting tossing ball 10 may have an internal volume 40 that is larger than, smaller than, and/or equal to the size of the internal volume 40 of the everting tossing ball in its nominal configuration. Some everting tossing balls will have a plurality of force-absorbing resilient fingers 80 only on the outwardly facing surfaces 32 of the plurality of interconnected resilient ribs 30 when the ball is in its nominal configuration. Such balls thus will have a plurality of force-absorbing resilient fingers 80 only on the inwardly facing surfaces 34 of the plurality of interconnected resilient ribs when the ball is in its everted configuration. Such internally extending fingers may be described as extending into the internal volume of the tossing ball and may intersect or otherwise engage others of the internally extending fingers. Thus, the force-absorbing resilient fingers will contact an external object before the remainder of the tossing ball when the tossing ball is thrown against an external object when the tossing ball is in its nominal configuration, but the contact surfaces of the ribs will contact the external object before the remainder of the tossing ball when the tossing ball is thrown against the external object when the tossing ball is in its everted configuration.

The manner and force at which the ball rebounds from the external object may differ between these examples, at least due to the outwardly extending force-absorbing resilient fingers not making the initial contact with the external object when the ball is in its everted configuration. In addition, the aerodynamic properties of an everting tossing ball 10 according to the present disclosure may differ depending upon whether the ball is in its nominal configuration or its everted configuration. As an example, an everting tossing ball may exhibit greater wind resistance when a greater number (or all) of the tossing ball's resilient force-absorbing fingers extend from the outwardly facing surface of ribs 30, such as in a nominal configuration, than when the fingers extend from the inwardly facing surface of ribs 30, such as in an exerted configuration. A greater or lesser amount of wind resistance thus may affect the distance that a tossing ball 10 travels when thrown and/or the speed/force at which it impacts an external object.

Tossing balls 10 may be formed, at least substantially, from any suitable resilient material, and in some embodiments the entirety of the tossing ball may be formed from one or more resilient materials. In some embodiments, tossing ball 10 may be entirely formed from the same resilient material. In some embodiments, tossing ball 10 may be formed entirely from one or more resilient materials, except for one or more couplers 62 (when present) that are formed from one or more different materials, as discussed herein. In some embodiments, the resilient material is a resilient elastomeric material. Examples of suitable resilient elastomeric materials are those that permit the corresponding portion of the tossing ball to exhibit (resiliently and without damage) at least 75%, at least 100%, at least 150%, and/or at least 200% elongation.

Examples of suitable resilient materials include silicone, silicone rubber, latex rubber, a thermoplastic elastomer (TPE), a thermoplastic rubber (TPR), a thermoplastic urethane, and styrene block copolymers. Other examples of suitable resilient materials include materials that have a resiliency and/or elasticity that is the same as or within ten percent (+/−10%) of the resiliency and/or elasticity of one of these materials. Additional examples of suitable materials are materials that have a durometer in the range of 40-70 shore A. Further examples of suitable materials are those that enable the tossing ball to be compressed, such as manually using a user's hands, to volume that is at least 50%, at least 40%, at least 30%, at least 20%, and/or at least 10% of the volume of the tossing ball, such as when in its nominal configuration, and thereafter enable the tossing ball to resiliently return to the nominal configuration without damage or destruction of the tossing ball.

Tossing balls 10 according to the present disclosure may be formed by any suitable method, or process, sufficient to produce balls with the structure and characteristics described herein. Examples of suitable methods include molding at least components of balls 10, at least substantial portions of balls 10, and optionally the entirety of balls 10. Examples of suitable molding methods include injection molding, compression molding, transfer molding, liquid injection molding, and thermoplastic injection molding. For example, ribs 30 may be formed from one or more of the methods described above, and then the ribs may be interconnected, such as with a bonding agent and/or couplers 60 that are formed from the same or different materials. As another example, the entirety of a tossing ball 10 may be formed by one or more of the methods described above to produce a tossing ball having a unitary, integrally formed, or monolithic structure. As another example, when the tossing ball 30 includes double-ended ribs, one end of each of the ribs may be integrally formed with and interconnect to a node 60, with the other ends of each of the ribs not being interconnected until they subsequently are interconnected with a bonding agent and/or a coupler 62. As yet another example, a plurality of ribs 30 may be formed, such as by one of the methods described above, with each of the ribs being formed without being interconnected with others of the plurality of ribs. Thereafter, a plurality of the individual ribs may be selectively interconnected at a plurality of nodes 60 with a bonding agent and/or with couplers 62.

As used herein, the terms "selective" and "selectively," when modifying an action, movement, configuration, or other activity of one or more components or characteristics of an apparatus, mean that the specific action, movement, configuration, or other activity is a direct or indirect result of user manipulation of an aspect of, or one or more components of, the apparatus.

As used herein, "at least substantially," when modifying a degree or relationship, includes not only the recited "substantial" degree or relationship, but also the full extent of the recited degree or relationship. A substantial amount of a recited degree or relationship may include at least 75% of the recited degree or relationship. For example, an object that is at least substantially formed from a material includes objects for which at least 75% of the objects are formed from the material and also includes objects that are completely formed from the material. As another example, a first length that is at least substantially as long as a second length includes first lengths that are at least 75% as long as the second length and also includes first lengths that are as long as the second length.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

Examples of tossing balls according to the present disclosure are presented in the following enumerated paragraphs.

A. A tossing ball, comprising:

a plurality of interconnected resilient ribs forming a resilient skeletal body of the tossing ball; wherein the resilient skeletal body defines an open internal volume of the tossing ball and a plurality of passages between adjacent resilient ribs of the plurality of interconnected resilient ribs; wherein the resilient skeletal body has an outwardly facing body portion and an inwardly facing body portion; and further wherein each of the plurality of passages extends from the outwardly facing body portion of the resilient skeletal body to the open internal volume.

A1. The tossing ball of paragraph A, wherein the tossing ball has a nominal configuration, and wherein in the nominal configuration, the resilient skeletal body has a first geometric shape.

A2. The tossing ball of paragraph A1, wherein the first geometric shape is at least one of spherical, ellipsoidal, an ovoid, a spheroid, an ellipsoid, and globular.

A3. The tossing ball of any of paragraphs A1-A2, wherein the first geometric shape is at least one of cubic, tetrahedral, pyramidal, hexahedral, octahedral, decahedral, and dodecahedral.

A4. The tossing ball of any of paragraphs A1-A3, wherein the first geometric shape defines a conformational volume, and further wherein the plurality of interconnected resilient ribs forms less of the conformational volume than the plurality of passages.

A5. The tossing ball of paragraph A4, wherein the plurality of passages form at least 55%, at least 60%, at least 70%, at least 75%, at least 80%, at least 90%, less than 90%, less than 80%, less than 75%, and/or less than 70% of the conformational volume.

A6. The tossing ball of any of paragraphs A-A5, wherein the tossing ball has a maximum linear body dimension that is at least 5 cm, at least 7.5 cm, at least 10 cm, at least 13 cm, at least 15 cm, at least 18 cm, less than 25 cm, less than 20 cm, less than 15 cm, less than 12 cm, less than 10 cm, in the range of 5-15 cm, in the range of 7.5-12.5 cm, in the range of 7.5-17.5 cm, and/or in the range of 10-20 cm.

A7. The tossing ball of any of paragraphs A-A6, wherein each of the passages is sized to permit at least one of a user's fingers to pass through the passage when the tossing ball is caught.

A8. The tossing ball of any of paragraphs A1-A7, wherein each of the passages has an area of at least 0.5 $cm^2$, at least 1 $cm^2$, at least 1.5 $cm^2$, at least 2 $cm^2$, at least 2.5 $cm^2$, at least 3.5 $cm^2$, at least 4.5 $cm^2$, at least 5.5 $cm^2$, at least 6.5

$cm^2$, at least 7.5 $cm^2$, less than 10 $cm^2$, less than 7 $cm^2$, less than 5 $cm^2$, less than 4 $cm^2$, less than 2.5 $cm^2$, and/or less than 2 $cm^2$.

A9. The tossing ball of any of paragraphs A1-A8, wherein the plurality of interconnected resilient ribs are a plurality of force-absorbing resilient ribs that are configured to cushion impact between the tossing ball and an external object.

A10. The tossing ball of any of paragraphs A1-A9, wherein upon impact between the tossing ball and an external object, at least one of the plurality of interconnected resilient ribs is configured to deflect resiliently toward the open internal volume.

A11. The tossing ball of any of paragraphs A1-A10, wherein the plurality of interconnected resilient ribs includes 3 resilient ribs, 4 resilient ribs, 5 resilient ribs, 6 resilient ribs, 8 resilient ribs, at least three resilient ribs, at least four resilient ribs, at least five resilient ribs, at least six resilient ribs, at least eight resilient ribs, less than fifteen resilient ribs, less than ten resilient ribs, less than eight resilient ribs, less than seven resilient ribs, and/or less than six resilient ribs.

A12. The tossing ball of any of paragraphs A1-A11, wherein all of the plurality of interconnected resilient ribs have the same shape.

A13. The tossing ball of any of paragraphs A1-A12, wherein some of the plurality of interconnected resilient ribs have a first shape, and further wherein some of the plurality of interconnected resilient ribs have a second shape that is different than the first shape.

A14. The tossing ball of any of paragraphs A1-A13, wherein each of the plurality of interconnected resilient ribs has a shape selected from the group consisting of an arcuate shape, a zigzag shape, a twisted shape, a wavy shape, a helical shape, a spiral shape, a lightning shape, a bistable shape, and an undulating shape, and optionally wherein at least one of the interconnected ribs further includes a closed-loop region.

A15. The tossing ball of any of paragraphs A1-A13, wherein each of the plurality of interconnected resilient ribs has a shape selected from the group consisting of an arcuate shape, a zigzag shape, a twisted shape, a wavy shape, a helical shape, a spiral shape, a lightning shape, a bistable shape, an undulating shape, and a ring-shaped shape.

A16. The tossing ball of any of paragraphs A1-A14, wherein at least a subset of the plurality of interconnected resilient ribs includes a first rib end and a second rib end that is distal the first rib end, and further wherein each of the subset of the plurality of interconnected resilient ribs has a shape selected from the group consisting of an arcuate shape, a zigzag shape, a twisted shape, a wavy shape, a helical shape, a spiral shape, a lightning shape, a bistable shape, and an undulating shape.

A17. The tossing ball of any of paragraphs A1-A14 and A16, wherein at least a subset of the plurality of interconnected resilient ribs includes a first rib end and a second rib end that is distal the first rib end, and further wherein all of the first rib ends of the subset of the plurality of interconnected resilient ribs are interconnected at a first node of the resilient skeletal body.

A18. The tossing ball of any of paragraphs A1-A14 and A16, wherein each resilient rib of the plurality of interconnected resilient ribs includes a first rib end and a second rib end that is distal the first rib end, and further wherein all of the first rib ends of the plurality of interconnected resilient ribs are interconnected at a first node of the resilient skeletal body.

A19. The tossing ball of any of paragraphs A16-A18, wherein the first rib end and the second rib end of each of the plurality of interconnected resilient ribs are opposed to each other.

A20. The tossing ball of any of paragraphs A17-A19, wherein some, but not all, of the second rib ends of the plurality of interconnected resilient ribs are interconnected at a second node of the resilient skeletal body.

A21. The tossing ball of any of paragraphs A17-A19, wherein all of the second rib ends of the plurality of interconnected resilient ribs are interconnected at a second node of the resilient skeletal body.

A22. The tossing ball of any of paragraphs A20-A21, wherein the first node of the resilient skeletal body and the second node of the resilient skeletal body are spaced apart from each other and aligned on a central axis of the resilient skeletal body.

A23. The tossing ball of any of paragraphs A1-A13, wherein at least some of the plurality of interconnected resilient ribs are ring-shaped ribs that each form a closed perimeter that define a central opening that forms a passage of the plurality of passages.

A24. The tossing ball of paragraph A23, wherein all of the plurality of interconnected resilient ribs are ring-shaped ribs that each form a closed perimeter that define a central opening that forms a passage of the plurality of passages.

A25. The tossing ball of any of paragraphs A23-A24, wherein the closed perimeter has a shape selected from the group consisting of a circle, a triangle, a rectangle, a polygon, an ellipse, and/or an oval.

A26. The tossing ball of any of paragraphs A1-A25, wherein the resilient skeletal body includes a plurality of nodes, and further wherein at each node of the plurality of nodes at least two resilient ribs of the plurality of interconnected resilient ribs are directly connected.

A27. The tossing ball of paragraph A26, wherein at each node of the plurality of nodes, at least three resilient ribs of the plurality of interconnected resilient ribs are directly connected.

A28. The tossing ball of any of paragraphs A26-A27, wherein at a node of the plurality of nodes, a majority of the resilient ribs of the plurality of interconnected resilient ribs are directly connected.

A29. The tossing ball of any of paragraphs A26-A28, wherein at each node of the plurality of nodes, all of the resilient ribs of the plurality of interconnected resilient ribs are directly connected.

A30. The tossing ball of any of paragraphs A26-A28, wherein for at least one node of the plurality of nodes, less than all of the plurality of interconnected resilient ribs are directly connected.

A31. The tossing ball of any of paragraphs A26-A30, wherein at least one of the nodes of the plurality of nodes includes a rib coupler that is configured to selectively and mechanically interconnect at least two of the plurality of interconnected resilient ribs.

A32. The tossing ball of paragraph A31, wherein each of the nodes of the plurality of nodes includes a rib coupler that is configured to selectively and mechanically interconnect at least two of the plurality of interconnected resilient ribs.

A33. The tossing ball of paragraph A31, wherein at least one, but not all, of the plurality of nodes includes a rib coupler that is configured to selectively and mechanically interconnect at least two of the plurality of interconnected resilient ribs.

A34. The tossing ball of any of paragraphs A31-A33, wherein each rib coupler is configured to selectively and mechanically interconnect at least a subset, but not all, of the plurality of interconnected ribs.

A35. The tossing ball of any of paragraphs A31-A33, wherein each rib coupler is configured to selectively and mechanically interconnect all of the plurality of interconnected ribs.

A36. The tossing ball of any of paragraphs A31-A35, wherein each rib coupler includes a plurality of sockets configured to receive a portion of at least a subset of the plurality of interconnected resilient ribs.

A37. The tossing ball of any of paragraphs A31-A35, wherein each rib coupler includes at least one pin configured to be inserted into at least one of the plurality of interconnected ribs.

A38. The tossing ball of any of paragraphs A31-A36, wherein each rib coupler is formed from a resilient material.

A39. The tossing ball of any of paragraphs A31-A38, wherein the rib coupler is formed from a different material than the plurality of interconnected ribs.

A40. The tossing ball of any of paragraphs A38-A39, wherein each rib coupler is formed from a less resilient material than a resilient material from which the plurality of interconnected resilient ribs are formed.

A41. The tossing ball of any of paragraphs A31-A40, wherein each rib coupler is configured to repeatedly receive and release the plurality of interconnected resilient ribs without destruction of or damage to the plurality of interconnected resilient ribs and the rib coupler.

A42. The tossing ball of any of paragraphs A1-A30, wherein the plurality of interconnected resilient ribs are adhered together at one or more nodes of the plurality of nodes.

A43. The tossing ball of any of paragraphs A1-A30, wherein the plurality of interconnected resilient ribs are integrally formed with each other.

A44. The tossing ball of any of paragraphs A1-A43, wherein the tossing ball further includes an array of force-absorbing resilient fingers extending from the plurality of interconnected resilient ribs; wherein the tossing ball has a nominal configuration in which the array of force-absorbing resilient fingers extends away from the open internal volume of the tossing ball and optionally are configured to cushion impact between the tossing ball and an external object.

A45. The tossing ball of paragraph A44, wherein the array of force-absorbing resilient fingers is integrally formed with the plurality of interconnected resilient ribs.

A46. The tossing ball of any of paragraphs A44-A45, wherein each resilient rib includes a projecting surface that includes a plurality of force-absorbing resilient fingers of the array of force-absorbing resilient fingers; wherein the plurality of force-absorbing resilient fingers is spaced apart on and extend from the projecting surface of the resilient rib.

A47. The tossing ball of paragraph A46, wherein upon impact with an external object, the plurality of force-absorbing resilient fingers are configured to resiliently deflect and to absorb at least a portion of the resulting impact forces imparted to the tossing ball.

A48. The tossing ball of any of paragraphs A46-A47, wherein upon impact with an external object, the plurality of force-absorbing resilient fingers are configured to absorb at least a portion of the resulting impact forces imparted to the tossing ball and to dampen a degree to which the tossing ball is urged away from the external object by the impact forces.

A49. The tossing ball of any of paragraphs A46-A48, wherein the tossing ball defines a geometric center, and further wherein each of the plurality of force-absorbing resilient fingers extends in a direction that is outward from the geometric center.

A50. The tossing ball of paragraph A49, wherein the tossing ball defines a geometric center and further wherein each of the plurality of force-absorbing resilient fingers extends in a direction that is radially outward from the geometric center.

A51. The tossing ball of any of paragraphs A46-A50, wherein the plurality of force-absorbing resilient fingers each have a length that is at least one of at least 0.5 cm, at least 1 cm, at least 1.5 cm, at least 2 cm, at least 3 cm, at least 4 cm, at least 5 cm, at least 6 cm, at least 7 cm, less than 15 cm, less than 10 cm, less than 7.5 cm, less than 5 cm, in the range of 0.5-3 cm, in the range of 1.5-5 cm, and/or in the range of 2.5-7.5 cm.

A52. The tossing ball of any of paragraphs A46-A51, wherein each resilient rib has a thickness measured between the projecting surface and an opposed contact surface of the resilient rib, and further wherein at least a majority of the plurality of the force-absorbing resilient fingers have a length that is greater than the thickness of the resilient rib.

A53. The tossing ball of paragraph A52, wherein the length is at least two times, at least three times, at least five times, and/or at least 10 times greater than the thickness of the resilient rib.

A54. The tossing ball of any of paragraphs A52-A53, wherein all of the plurality of force-absorbing resilient fingers have a length that is greater than the thickness of the resilient rib.

A55. The tossing ball of any of paragraphs A46-A54, wherein none of the plurality of interconnected resilient ribs include a second plurality of force-absorbing resilient fingers extending from a second projecting surface the resilient rib.

A56. The tossing ball of any of paragraphs A46-A54, wherein at least some of the plurality of interconnected resilient ribs include a second plurality of force-absorbing resilient fingers extending from a second projecting surface of the resilient rib; wherein the projecting surface of the resilient rib is a first projecting surface; wherein the plurality of force-absorbing resilient fingers that extend from the first projecting surface is a first plurality of force-absorbing resilient fingers; and wherein the second projecting surface is opposed to the first projecting surface of the resilient rib.

A57. The tossing ball of paragraph A56, wherein all of the plurality of interconnected resilient ribs include a second plurality of force-absorbing resilient fingers extending from a second projecting surface of the resilient rib.

A58. The tossing ball of any of paragraphs A56-A57, wherein the second plurality of force-absorbing resilient fingers have the same shape and size as the first plurality of force-absorbing resilient fingers.

A59. The tossing ball of any of paragraphs A56-A57, wherein the second plurality of force-absorbing resilient fingers are one of longer and shorter than the first plurality of force-absorbing resilient fingers.

A60. The tossing ball of any of paragraphs A56-A59, wherein for each of the plurality of interconnected resilient ribs that include the first plurality of force-absorbing resilient fingers and the second plurality of resilient fingers, the rib includes more of the second plurality of resilient fingers than the first plurality of force-absorbing resilient fingers.

A61. The tossing ball of paragraph A60, wherein for each of the plurality of interconnected resilient ribs that include the first plurality of force-absorbing resilient fingers and the second plurality of resilient fingers, the rib includes at least 50%, at least 75% and/or at least 100% more of the second plurality of resilient fingers than the first plurality of force-absorbing resilient fingers.

A62. The tossing ball of any of paragraphs A46-A61, wherein the plurality of force-absorbing resilient fingers on a resilient rib of the plurality of interconnected resilient ribs have the same length and are aligned on the resilient rib.

A63. The tossing ball of any of paragraphs A46-A62, wherein all of the plurality of force-absorbing resilient fingers on a resilient rib of the plurality of interconnected resilient ribs have one or more of the same finger properties.

A64. The tossing ball of paragraph A63, wherein the finger properties include one or more of size, shape, length, thickness, color, resiliency, and stiffness.

A65. The tossing ball of any of paragraphs A63-A64, wherein some of the plurality of force-absorbing resilient fingers on a resilient rib of the plurality of interconnected resilient ribs have one or more finger properties that differ from the finger properties of others of the plurality of force-absorbing resilient fingers on the resilient rib.

A66. The tossing ball of any of paragraphs A46-A65, wherein each of the plurality of force-absorbing resilient fingers has a base that is connected to a respective resilient rib of the plurality of interconnected resilient ribs, wherein the base has a transverse dimension measured transverse to a longitudinal axis of the force-absorbing resilient finger, and further wherein a distance between a respective resilient finger of the plurality of force-absorbing resilient fingers and a closest adjacent resilient finger of the plurality of force-absorbing resilient fingers is one of less than, equal to, and greater than the transverse dimension of the base.

A67. The tossing ball of any of paragraphs A1-A66, wherein the tossing ball has a nominal configuration in which the resilient skeletal body has a first geometric shape, and further wherein the resilient skeletal body is configured to be selectively everted to convert the tossing ball between the nominal configuration and an everted configuration in which the outwardly facing body portion and the inwardly facing body portion of the resilient skeletal body are reversed; and further wherein the tossing ball is configured to be selectively configured between the nominal configuration and the everted configuration without disassembly or destruction of the tossing ball.

A68. The tossing ball of paragraph A67, wherein in the nominal configuration, the resilient skeletal body has a first geometric shape, and further wherein in the everted configuration, the resilient skeletal body has a second geometric shape that is different than the first geometric shape.

A69. The tossing ball of paragraph A68, wherein a first one of the first geometric shape and the second geometric shape is one of spherical, elliptical, ovoid, a spheroid, and an ellipsoid, and further wherein a second one of the first shape and the second shape is cubic, tetrahedral, pyramidal, hexahedral, octahedral, decahedral, and dodecahedral.

A70. The tossing ball of any of paragraphs A67-A69, wherein the open internal volume is smaller when the resilient skeletal body is in the everted configuration than when the resilient skeletal body is in the nominal configuration.

A71. The tossing ball of any of paragraphs A67-A70, when further dependent upon any of paragraphs A46-A66, wherein in the nominal configuration, a plurality of force-absorbing resilient fingers of the array of force-absorbing resilient fingers extends from the outwardly facing body portion of the resilient skeletal body.

A72. The tossing ball of any of paragraphs A67-A71, when further dependent upon any of paragraphs A46-A66, wherein in the everted configuration, the plurality of force-absorbing resilient fingers extends into the open internal volume of the tossing ball.

A73. The tossing ball of any of paragraphs A67-A72, when further dependent upon any of paragraphs A46-A66, wherein in the nominal configuration, the plurality of force-absorbing resilient fingers extends away from the open internal volume of the tossing ball.

A74. The tossing ball of any of paragraphs A67-A73, when further dependent upon any of paragraphs A46-A66, wherein in the everted configuration, the plurality of force-absorbing resilient fingers extends from the inwardly facing body portion of the resilient skeletal body.

A75. The tossing ball of any of paragraphs A67-A74, when further dependent upon any of paragraphs A46-A66, wherein in the everted configuration, the plurality of force-absorbing resilient fingers extends into the open internal volume of the tossing ball.

A76. The tossing ball of any of paragraphs A67-A75, when further dependent upon any of paragraphs A46-A66, wherein in the everted configuration, the each of the plurality of force-absorbing resilient fingers extends into the open internal volume of the tossing ball and intersect other force-absorbing resilient fingers of the plurality of force-absorbing resilient fingers.

A77. The tossing ball of any of paragraphs A1-A76, wherein the plurality of interconnected resilient ribs is formed from a resilient material.

A78. The tossing balls of any of paragraphs A71-A77, when dependent from any of paragraphs A46-A66, wherein the plurality of interconnected resilient ribs and the plurality of force-absorbing resilient fingers are formed from a resilient material, and optionally the same resilient material.

A79. The tossing ball of any of paragraphs A1-A78, wherein the tossing ball is at least substantially formed from a resilient material.

A80. The tossing ball of any of paragraphs A1-A79, wherein the tossing ball is completely formed from a resilient material.

A81. The tossing ball of any of paragraphs A77-A80, wherein the resilient material is a resilient elastomeric material.

A82. The tossing ball of paragraph A81, wherein the resilient elastomeric material has an elastic elongation of at least 75%, at least 100%, at least 150%, and/or 200%.

A83. The tossing ball of any of paragraphs A77-A82, wherein the resilient material has a durometer in the range of 40-70 Shore A.

A84. The tossing ball of any of paragraphs A77-A83, wherein the resilient material includes at least one of silicone, silicone rubber, latex rubber, a thermoplastic elastomer, a thermoplastic rubber, a thermoplastic urethane, and a styrene block copolymer.

A85. The tossing ball of any of paragraphs A77-A84, wherein the resilient material has a resiliency that is at least substantially the same as, optionally within ten percent of, and further optionally the same as, the resiliency of silicone rubber.

A86. The tossing ball of any of paragraphs A77-A85, wherein the resilient material has an elasticity that is at least substantially the same as, optionally within ten percent of, and further optionally the same as the elasticity of silicone rubber.

INDUSTRIAL APPLICABILITY

The balls and methods disclosed herein are applicable to the toy, recreational products, and children's products industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A tossing ball, comprising;

a plurality of interconnected resilient ribs forming a resilient skeletal body of the tossing ball; wherein the resilient skeletal body defines an open internal volume of the tossing ball and a plurality of passages between adjacent resilient ribs of the plurality of interconnected resilient ribs; wherein the resilient skeletal body has an outwardly facing body portion and an inwardly facing body portion; and further wherein each of the plurality of passages extends from the outwardly facing body portion of the resilient skeletal body to the open internal volume; and an array of force-absorbing resilient fingers extending from the plurality of interconnected resilient ribs; wherein the tossing ball has a nominal configuration in which the array of force-absorbing resilient fingers extend away from the open internal volume of the tossing ball; wherein each force-absorbing resilient finger of the array of force-absorbing resilient fingers has a length, and each force-absorbing resilient finger of the array of force-absorbing resilient fingers has a longitudinal axis projecting transversely from a corresponding resilient rib of the plurality of interconnected resilient ribs; wherein at least 75% of the length of each force-absorbing resilient finger extends along the longitudinal axis.

2. The tossing ball of claim 1, wherein the resilient skeletal body defines an external conformational volume, and further wherein the plurality of interconnected resilient ribs occupies less of the external conformational volume than is occupied by the plurality of passages.

3. The tossing ball of claim 1, wherein the plurality of interconnected resilient ribs are a plurality of force-absorbing resilient ribs that are configured to cushion impact between the tossing ball and an external object.

4. The tossing ball of claim 1, wherein at least a subset of the plurality of interconnected resilient ribs includes a first rib end and a second rib end that is distal the first rib end, and further wherein each of the subset of the plurality of interconnected resilient ribs has a zigzag shape, a twisted shape, a wavy shape, a helical shape, a spiral shape, a lightning shape, a bistable shape, and an undulating shape.

5. The tossing ball of claim 1, wherein at least a subset of the plurality of interconnected resilient ribs includes a first rib end and a second rib end that is distal the first rib end, and further wherein all of the first rib ends of the subset of the plurality of interconnected resilient ribs are interconnected at a first node of the resilient skeletal body.

6. The tossing ball of claim 5, wherein at least some of the second rib ends of the subset of the plurality of interconnected ribs are interconnected at a second node of the resilient skeletal body.

7. The tossing ball of claim 1, wherein at least some of the plurality of interconnected resilient ribs are ring-shaped ribs that each foam a closed perimeter that define a central opening that extends from the outwardly facing body portion of the resilient skeletal body to the open internal volume.

8. The tossing ball of claim 1, wherein each resilient rib includes a projecting surface that includes a plurality of force-absorbing resilient fingers of the array of force-absorbing resilient fingers; wherein the plurality of force-absorbing resilient fingers are spaced apart on and extend from the projecting surface of the resilient rib; and further wherein upon impact with an external object, the plurality of force-absorbing resilient fingers are configured to absorb at least a portion of the resulting impact forces imparted to the tossing ball and to dampen a degree to which the tossing ball is urged away from the external object by the impact forces.

9. The tossing ball of claim 8, wherein at least some of the plurality of interconnected resilient ribs include a second plurality of force-absorbing resilient fingers extending from a second projecting surface of the resilient rib; wherein the projecting surface of the resilient rib is a first projecting surface; wherein the plurality of force-absorbing resilient fingers that extend from the first projecting surface is a first plurality of force-absorbing resilient fingers; and wherein the second projecting surface is opposed to the first projecting surface of the resilient rib.

10. The tossing ball of claim 1, wherein in the nominal configuration, the tossing ball has a first geometric shape, and further wherein the resilient skeletal body is configured to be everted from the nominal configuration to an everted configuration without disassembly or destruction of the tossing ball; and further wherein in the everted configuration, the tossing ball has a second geometric shape that is different from the first geometric shape.

11. The tossing ball of claim 10, wherein the first geometric shape is one of cubic, tetrahedral, pyramidal, hexahedral, octahedral, decahedral, and dodecahedral; and further wherein the second geometric shape is one of spherical, ellipsoidal, ovoid, spheroid, and ellipsoid.

12. The tossing ball of claim 10, wherein the first geometric shape is one of spherical, ellipsoidal, ovoid, spheroid, and ellipsoid, and further wherein the second geometric shape is one of cubic, tetrahedral, pyramidal, hexahedral, octahedral, decahedral, and dodecahedral.

13. The tossing ball of claim 10, wherein in the everted configuration, the array of force-absorbing resilient fingers extends into the open internal volume of the tossing ball.

14. The tossing ball of claim 1, wherein each of the passages has an area of at least 5.5 $cm^2$.

15. The tossing ball of claim 1, wherein the plurality of interconnected resilient ribs are formed from a resilient material, and further wherein the array of force-absorbing resilient fingers are formed from the same resilient material as the plurality of interconnected resilient ribs.

16. The tossing ball of claim 15, wherein the resilient material is a resilient and elastomeric material.

17. The tossing ball of claim 1, wherein the array of force-absorbing resilient fingers is integrally molded with the plurality of interconnected resilient ribs.

18. The tossing ball of claim 1, wherein the plurality of interconnected resilient ribs are integrally molded with each other.

19. The tossing ball of claim 1, wherein the tossing ball further includes at least one rib coupler, wherein at least some of the plurality of interconnected resilient ribs are mechanically coupled together by the at least one rib coupler; wherein each rib coupler comprises a plurality of receivers; and further wherein each receiver is configured to selectively receive at least one of the plurality of interconnected resilient ribs.

20. The tossing ball of claim 19, wherein each rib coupler is configured to selectively and repeatedly receive and release individual resilient ribs of the plurality of interconnected resilient ribs without destruction of or damage to the plurality of interconnected resilient ribs and the rib coupler and without disassembly of the rib coupler.

21. A tossing ball, comprising;

a plurality of interconnected resilient ribs forming a resilient skeletal body of the tossing ball; wherein the resilient skeletal body defines an open internal volume of the tossing ball and a plurality of passages between adjacent resilient ribs of the plurality of interconnected resilient ribs; wherein the resilient skeletal body has an outwardly facing body portion and an inwardly facing body portion; wherein each of the plurality of passages extends from the outwardly facing body portion of the resilient skeletal body to the open internal volume; and further wherein at least some of the plurality of interconnected resilient ribs are ring-shaped ribs that each form a closed perimeter that define a central opening that extends from the outwardly facing body portion of the resilient skeletal body to the open internal volume; and an array of force-absorbing resilient fingers extending from the plurality of interconnected resilient ribs; wherein the tossing ball has a nominal configuration in which the array of force-absorbing resilient fingers extend away from the open internal volume of the tossing ball.

22. The tossing ball of claim 21, wherein each resilient rib includes a projecting surface that includes a plurality of force-absorbing resilient fingers of the array of force-absorbing resilient fingers; wherein the plurality of force-absorbing resilient fingers are spaced apart on and extend from the projecting surface of the resilient rib; and further wherein upon impact with an external object, the plurality of force-absorbing resilient fingers are configured to absorb at least a portion of the resulting impact forces imparted to the tossing ball and to dampen a degree to which the tossing ball is urged away from the external object by the impact forces.

23. The tossing ball of claim 21, wherein in the nominal configuration, the tossing ball has a first geometric shape, and further wherein the resilient skeletal body is configured to be everted from the nominal configuration to an everted configuration without disassembly or destruction of the tossing ball; and further wherein in the everted configuration, the tossing ball has a second geometric shape that is different from the first geometric shape.

24. The tossing ball of claim 23, wherein the first geometric shape is one of cubic, tetrahedral, pyramidal, hexahedral, octahedral, decahedral, and dodecahedral; and further wherein the second geometric shape is one of spherical, ellipsoidal, ovoid, spheroid, and ellipsoid.

25. The tossing ball of claim 23, wherein the first geometric shape is one of spherical, ellipsoidal, ovoid, spheroid, and ellipsoid, and further wherein the second geometric shape is one of cubic, tetrahedral, pyramidal, hexahedral, octahedral, decahedral, and dodecahedral.

26. The tossing ball of claim 21, wherein the array of force-absorbing resilient fingers is integrally molded with the plurality of interconnected resilient ribs.

27. The tossing ball of claim 21, wherein the plurality of interconnected resilient ribs are integrally molded with each other.

* * * * *